US008849149B2

(12) United States Patent
Itoh

(10) Patent No.: US 8,849,149 B2
(45) Date of Patent: Sep. 30, 2014

(54) IMAGE FORMING APPARATUS THAT MEASURES TEMPERATURES AT FIRST AND SECOND LOCATIONS AND THAT CHANGES THE EXPOSURE CONDITION FOR EXPOSURE AT A THIRD LOCATION BASED ON THE MEASURED TEMPERATURES, AND CORRESPONDING IMAGE FORMING METHOD

(71) Applicant: Canon Kabushiki Kaisha, Tokyo (JP)

(72) Inventor: Isami Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,196

(22) Filed: Jan. 14, 2013

(65) Prior Publication Data

US 2013/0129368 A1 May 23, 2013

Related U.S. Application Data

(63) Continuation of application No. 12/104,238, filed on Apr. 16, 2008, now Pat. No. 8,385,768.

(30) Foreign Application Priority Data

Apr. 18, 2007 (JP) ..... 2007-109834
Feb. 29, 2008 (JP) ..... 2008-051317

(51) Int. Cl.
*G03G 15/00* (2006.01)
*G03G 21/20* (2006.01)

(52) U.S. Cl.
CPC ..... *G03G 21/20* (2013.01); *G03G 15/5045* (2013.01)
USPC ..... 399/96; 399/44; 399/51; 399/159

(58) Field of Classification Search
USPC ..... 399/44, 46, 51, 52, 96, 159
See application file for complete search history.

(56) References Cited

U.S. PATENT DOCUMENTS 5,191,362 A * 3/1993 Ichikawa ..... 399/44
8,385,768 B2 * 2/2013 Itoh ..... 399/96

* cited by examiner

*Primary Examiner* — David Gray
*Assistant Examiner* — Laura Roth
(74) *Attorney, Agent, or Firm* — Canon U.S.A., Inc. IP Division

(57) ABSTRACT

An image forming apparatus includes temperature sensors that measure temperatures at different locations in the longitudinal direction of a photosensitive drum. The image forming apparatus also includes an image processing circuit configured to change an exposure condition in the longitudinal direction of the photosensitive drum based on measured values obtained by the temperature sensors. A related image forming method includes calculating a temperature at a third location between the first and second location based on the measured temperatures at the first location and the second location, and controlling an exposure condition for exposure at the third location in accordance with image information, including changing the exposure condition for the exposure at the third location based on the calculated temperature at the third location.

6 Claims, 17 Drawing Sheets

IMAGE FORMING APPARATUS THAT MEASURES TEMPERATURES AT FIRST AND SECOND LOCATIONS AND THAT CHANGES THE EXPOSURE CONDITION FOR EXPOSURE AT A THIRD LOCATION BASED ON THE MEASURED TEMPERATURES, AND CORRESPONDING IMAGE FORMING METHOD

CROSS-REFERENCE TO RELATED APPLICATIONS

This application is a continuation of U.S. patent application Ser. No. 12/104,238 filed on Apr. 16, 2008 (now U.S. Pat. No. 8,385,768), which claims priority to Japanese Patent Application No. 2007-109834 filed Apr. 18, 2007 and Japanese Patent Application No. 2008-051317 filed Feb. 29, 2008. Each of U.S. patent application Ser. No. 12/104,238, Japanese Patent Application No. 2007-109834, and Japanese Patent Application No. 2008-051317 is hereby incorporated by reference herein in its entirety.

BACKGROUND OF THE INVENTION

1. Field of the Invention

The present invention relates to an image forming apparatus, such as an electrophotographic copier, laser beam printer, or facsimile machine.

2. Description of the Related Art

There is a known electrophotographic image forming apparatus that electrostatically forms a toner image on the surface of a photo conductor serving as an image bearing member and electrostatically transfers the image to a recording material (for example, paper) in close contact therewith. In such an image forming apparatus, a conductive transfer roller or corona charger is used as a transfer member.

For example, the transfer member is pressed into contact with or brought in the proximity of a photo conductor, thus forming a transfer portion between the photo conductor and the transfer member. A recording material is passed through the transfer portion and a transfer bias voltage that has an opposite polarity to that of a toner image formed on the photo conductor is applied to the transfer member, thereby transferring the toner image on the photo conductor to the surface of the photo conductor.

Typical examples of the photo conductor for use in the image forming apparatus described above include an organic photo conductor (OPC) and an amorphous silicon photo conductor (hereinafter referred to as an "a-Si photo conductor"). The a-Si photo conductor is used as an electrophotographic photo conductor in, for example, a high-speed copier or laser beam printer because it has a high hardness, exhibits high sensitivity to a semiconductor laser, and also suffers very little degradation caused by repeated use.

The potential decay (dark decay) occurring after the completion of charging when the a-Si photo conductor is used is larger than that occurring when the organic photo conductor is used. It is well known that the potential decay characteristics of the photo conductor have temperature dependence. Therefore, it is well known that an exposure dose varied in consideration of change in potential decay characteristics dependent on the overall temperature of the image forming apparatus can be employed.

However, in known techniques, only overall temperature changes inside the image forming apparatus are considered. In operation of the image forming apparatus, temperature may be distributed inside the image forming apparatus by unbalanced arrangement of heat sources, such as a fixing device and motor, and airflow. As a result, uneven temperature distribution may be produced in the longitudinal direction of the photo conductor. In this case, because the degree of influence of temperature on the potential decay characteristics varies in the longitudinal direction of the photo conductor, even when the exposure dose is adjusted in accordance with the overall temperature of the image forming apparatus, as in known techniques, the photo conductor may not be optimally exposed in the longitudinal direction thereof. This problem is apt to be noticeable in an a-Si photo conductor, which is largely affected by temperature decay characteristics.

SUMMARY OF THE INVENTION

The present invention provides an image forming apparatus capable of forming an excellent image whose image-density irregularities are suppressed even when unevenness in temperature is present inside the image forming apparatus.

According to an aspect of the present invention, an image forming apparatus includes a photo conductor, a charging device, an exposure device, a developing device, a temperature measuring device, and a control device. The charging device is configured to charge a surface of the photo conductor. The exposure device is configured to expose the charged surface of the photo conductor and to form an electrostatic image thereon. The developing device is configured to attach toner to the electrostatic image and to develop the electrostatic image as a toner image. The temperature measuring device is configured to measure temperatures in at least two different locations in a longitudinal direction of the photo conductor. The control device is configured to control an exposure condition for exposure performed by the exposure device in accordance with image information, the control device being operable to change the exposure condition for exposure performed by the exposure device in the longitudinal direction of the photo conductor based on a measurement result of the temperature measuring device.

According to another aspect of the present invention, an image forming method includes charging a surface of a photo conductor, exposing the charged surface of the photo conductor to form an electrostatic image thereon, attaching toner to the electrostatic image and developing the electrostatic image as a toner image, measuring temperatures in at least two different locations in a longitudinal direction of the photo conductor, and controlling an exposure condition for such exposure in accordance with image information, including changing the exposure condition for the exposure in the longitudinal direction of the photo conductor based on the measured temperatures.

Further features of the present invention will become apparent from the following description of exemplary embodiments with reference to the attached drawings.

DESCRIPTION OF THE EMBODIMENTS

An image forming apparatus according to embodiments of the present invention is described in detail below with reference to the accompanying drawings.

First Embodiment

Structure and Operation of Image Forming Apparatus

Figure 1:
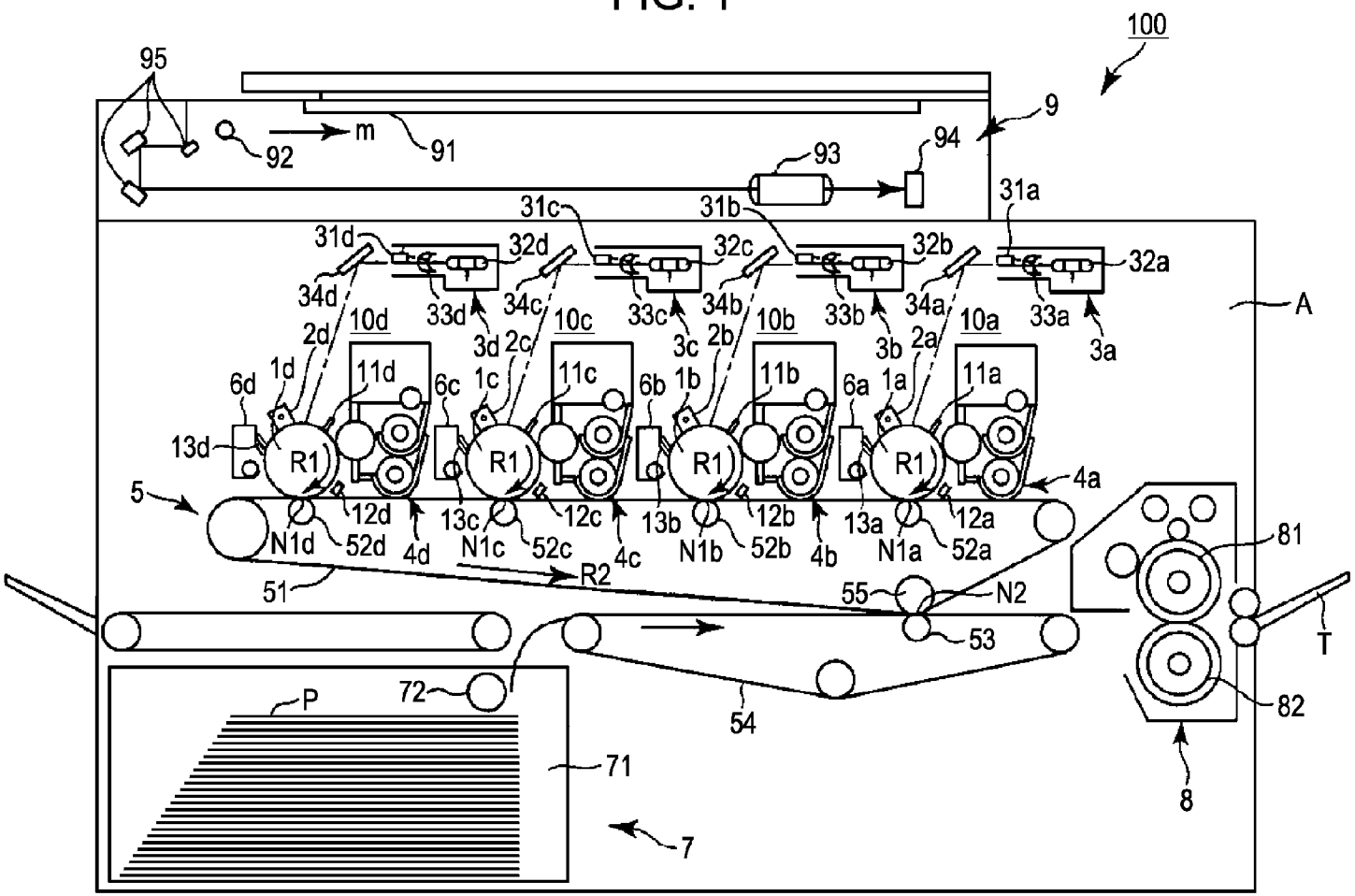
FIG. 1 is a schematic sectional view that illustrates a structure of an image forming apparatus according to an embodiment of the present invention.

FIG. 1 is a schematic vertical sectional view that illustrates a structure of an image forming apparatus according to an embodiment of the present invention. An image forming apparatus 100 of the present embodiment is a laser beam printer that employs the tandem system and the intermediate transfer process and can form a full-color image.

The image forming apparatus 100 includes first, second, third, and fourth image forming portions 10*a*, 10*b*, 10*c*, and 10*d* as a plurality of image forming units inside a main body A of the image forming apparatus (hereinafter, the main body of the image forming apparatus is referred to as a "main body of the apparatus"). In the present embodiment, the first, second, third, and fourth image forming portions 10*a*, 10*b*, 10*c*, and 10*d* form yellow, magenta, cyan, and black images, respectively. In the present embodiment, structures and operations of the first to fourth image forming portions 10*a* to 10*d* are substantially the same, except that the image forming portions use different toner colors. In the following description, only when it is necessary to distinguish among them, the suffixes a, b, c, and d are added to reference numerals to indicate that elements corresponding to the reference numerals are dedicated to the respective colors. Otherwise, such suffixes are omitted and the elements are collectively described.

The image forming portion 10 includes a drum-type electrophotographic photo conductor (hereinafter referred to as a "photosensitive drum") 1 as an image bearing member. The photosensitive drum 1 is rotated in the direction of the arrow R1 in the drawing. A charging device 2 as a charging unit and an exposure device 3 (laser scanner) 3 as an exposure unit (exposure system) are disposed around the photosensitive drum 1. In addition, a developing device 4 as a developing unit and a cleaning device (cleaner) 6 as a cleaning unit are disposed around the photosensitive drum 1. A transfer device 5 is disposed so as to face the photosensitive drums 1*a* to 1*d* of the image forming portions 10*a* to 10*d*. In the present embodiment, a potential sensor 11 as a detecting unit configured to detect the potential of the surface of the photosensitive drum 1 and a temperature sensor 12 as a temperature measuring device configured to measure temperature of adjacent areas of the surface of the photosensitive drum 1 are disposed around the photosensitive drum 1. As will be described in detail below, at least two temperature sensors are disposed along the longitudinal direction of the photosensitive drum 1 (the direction of an axis of rotation). Additionally, a pre-exposure device (pre-exposure light source) 13 as a charge neutralizing unit configured to remove charges on the photosensitive drum 1 is disposed around the photosensitive drum 1.

The transfer device 5 includes an endless intermediate transfer belt 51 as an intermediate transfer member. The intermediate transfer belt 51 is wound around rollers as a supporting member and is moved around them (rotated) in the direction of the arrow R2 in the drawing. Primary transfer rollers 52*a* to 52*d* as a primary transfer portion are disposed inside the intermediate transfer belt 51 so as to face the photosensitive drums 1*a* to 1*d*, respectively. The primary roller 52 presses the intermediate transfer belt 51 against the photosensitive drum 1 and forms a nip portion (primary transfer nip) at a primary transfer portion N1 where the photosensitive drum 1 and the intermediate transfer belt 51 are in contact with each other. A secondary transfer roller 53 constituting a secondary transfer portion and a conveying belt 54 are disposed outside the intermediate transfer belt 51 so as to face one roller (secondary transfer opposite roller) 55 of rollers around which the intermediate transfer belt 51 is wound. The secondary transfer roller 53 is disposed inside the conveying belt 54 and is in contact with the secondary transfer opposite roller 55 via the conveying belt 54 and the intermediate transfer belt 51 arranged therebetween. This forms a nip portion (secondary transfer nip) at a secondary transfer portion N2 being a contact portion between the intermediate transfer belt 51 and the conveying belt 54.

A charge position charged by the charging device 2, an exposure position exposed by the exposure device 3, a development position developed by the developing device 4, a primary transfer position primarily transferred by the primary transfer roller 52, and a cleaning position cleaned by the cleaning device 6 on the photosensitive drum 1 are arranged in this order along the rotational direction of the photosensitive drum 1. In the present embodiment, a potential detection position detected by the potential sensor 11 on the photosensitive drum 1 is arranged downstream of the exposure position and upstream of the development position in the rotational direction of the photosensitive drum 1. In the present embodiment, a circumferential temperature measurement position measured by the temperature sensor 12 on the photosensitive drum 1 is arranged downstream of the development position and upstream of the primary transfer position in the rotational direction of the photosensitive drum 1. In the present embodiment, a charge neutralization position performed by the pre-exposure device 13 on the photosensitive drum 1 is arranged downstream of the cleaning position and upstream of the charge position in the rotational direction of the photosensitive drum 1.

A conveying device 7 as a recording-material supplying unit, a fixing device 8 as a fixing unit, and a recording-material output tray T as a recording-material eject unit are arranged inside the main body A of the apparatus in this order from the upstream along the direction of conveyance of a recoding material (for example, paper) P. In addition, an image reading device (original plate scanner) 9 as an image reading unit is disposed above the main body A of the apparatus.

The photosensitive drum 1 is one in which a-Si photo conductor layers are laminated on the periphery of an aluminum cylinder. The photosensitive drum 1 is rotated by a driving unit (not shown) in the direction of the arrow R1 in the drawing at a predetermined process speed. The photosensitive drum 1 will be described in greater detail below.

The surface of the photosensitive drum 1 is uniformly charged by the charging device 2 to have a predetermined polarity and a predetermined potential. One example of the charging device 2 is a corona charger that is in non-contact with the photosensitive drum 1.

The charged photosensitive drum 1 is scanned and exposed by the exposure device 3, and an electrostatic (latent) image is thereby formed on the surface of the photosensitive drum 1. The image reading device 9 includes a light source 92 movable in the direction of the arrow m and in a direction opposite thereto. The light source 92 irradiates an image surface of a document placed on an original plate glass 91, the image surface facing down. Light reflected from the image surface is read by a charge-coupled device (CCD) (full-color sensor) 94 being an image pickup element (photoelectric conversion element) via a reflector 95 and a lens 93. Read image information is processed as appropriate and then input to the exposure device 3. The exposure device 3 exposes the surface of the photosensitive drum 1 in accordance with the image information input from the image reading device 9 and forms an electrostatic latent image thereon. The exposure device 3 includes a laser oscillator 31, a polygonal mirror 32, a lens 33, and a reflector 34.

Toner is attached to the electrostatic latent image formed on the surface of the photosensitive drum 1 by the developing device 4, and the electrostatic latent image is developed as a toner image.

The toner image formed on the photosensitive drum 1 is transferred (primarily) to the intermediate transfer belt 51 by the primary transfer roller 52. At this time, a voltage (primary transfer bias) having a polarity opposite to a normal charge polarity of toner is applied to the primary transfer roller 52.

In full-color image forming, for example, the charging, exposing, and primarily transferring processes described above are performed in the first to fourth image forming portions 10*a* to 10*d*. At the primary transfer portions N1*a* to N1*d*, toner images of different colors are sequentially overlaid and are primarily transferred onto the intermediate transfer belt 51. Thus, superimposed images are formed on the intermediate transfer belt 51.

The recording material P accommodated in a recording-material cassette 71 of the conveying device 7 is transported by a recording-material supply roller 72 and is supported on the surface of the conveying belt 54 wound around a plurality of rollers by a conveying roller and other elements.

The toner images formed on the intermediate transfer belt 51 are collectively transferred (secondarily) to the surface of the recording material P supported on the conveying belt 54. At this time, a voltage (secondary transfer bias) having a polarity opposite to a normal charge polarity of toner is applied to the secondary transfer roller 53.

The recording material P with the combined toner image transferred is conveyed to the fixing device 8 by the conveying belt 54. In the fixing device 8, the toner image is heated and pressed by a fixing roller 81 and a pressing roller 82, and the toner image is fixed on the surface. Subsequently, the recording material P is ejected onto the recording-material output tray T.

Toner remaining on the photosensitive drum 1 after the completion of a primary transfer process is removed and collected by the cleaning device 6. Toner remaining on the intermediate transfer belt 51 after the completion of a secondary transfer process is removed and collected by an intermediate transfer member cleaner (not shown).

The image forming apparatus 100 according to the present embodiment can also form a monochrome image using only the fourth image forming portion 10*d*, for example. In this case, an image forming operation is the same as that described above, except that there are image forming portions that do not perform image formation.

The photosensitive drum 1 composed of an a-Si photo conductor will now be described with reference to FIGS. 2A to 2F. Each of FIGS. 2A to 2F is a schematic diagram that illustrates a part of portions located above an axis of the photosensitive drum 1 in a vertical sectional view that includes the axis.

For an a-Si photo conductor as an image bearing member that has a photoconductive layer at its surface, the photoconductive layer is formed from a non-single-crystal material that contains silicon atoms as a matrix and at least one of hydrogen atoms and halogen atoms (hereinafter, this material is referred to as an a-Si: H, X (H represents a hydrogen atom and X represents a halogen atom)).

Figure 2A:
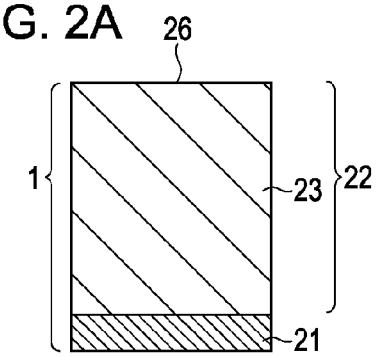
FIGS. 2A to 2F are schematic sectional views for describing a layered structure of a photo conductor.

The photosensitive drum 1 shown in FIG. 2A includes a cylindrical conductive drum (support) 21 and a photosensitive layer 22 formed on the surface of the conductive drum 21. The conductive drum 21 is composed of, for example, aluminum as a photo conductor. The photosensitive layer 22 includes a photoconductive layer 23 composed of a-Si: H, X.

Figure 2B:
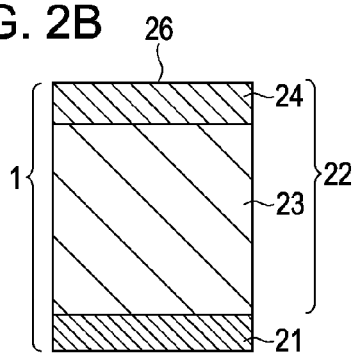
Figure 2C:
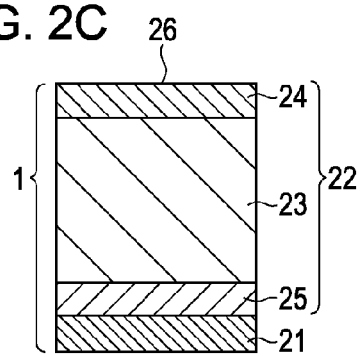
Figure 2D:
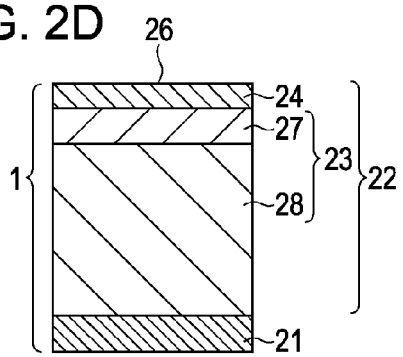
Figure 2E:
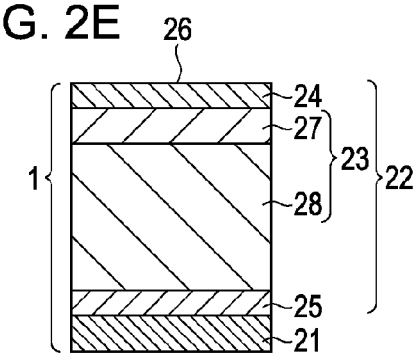
Figure 2F:
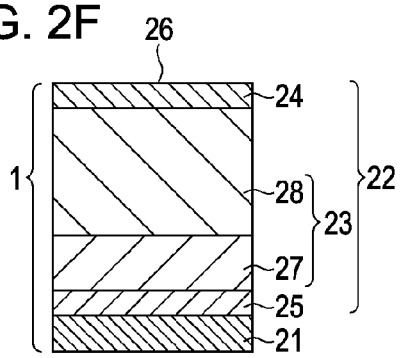

The photosensitive drum 1 shown in FIG. 2B includes a conductive drum 21 and a photosensitive layer 22 formed on the surface of the conductive drum 21. The conductive drum 21 is composed of, for example, aluminum as a photo conductor. The photosensitive layer 22 includes a photoconductive layer 23 composed of a-Si: H, X and an amorphous silicon based surface layer 24.

Furthermore, as illustrated in FIGS. 2C to 2F, the photosensitive layer 22 may further include an amorphous silicon based charge injection blocking layer 25. The photoconductive layer 23 may include a charge generation layer 27 and a charge transport layer 28 that are composed of a-Si: H, X. The amorphous silicon based surface layer 24 may be included in the photoconductive layer 23.

The charge injection blocking layer 25 is disposed as needed to block charges from being injected from the conductive drum 21 to the photoconductive layer 23. The conductive drum 21 may be conductive in itself, or alternatively, be electrically insulative one that is electrically conductive treated.

The photoconductive layer 23 being a part of the photosensitive layer 22 overlies the conductive drum 21 or, as required, an underlayer (not shown). The photoconductive layer 23 can be formed by well-known techniques for depositing thin films, such as plasma (enhanced) chemical vapor deposition (p-CVD), sputtering, vacuum deposition, ion plating, photo CVD, and thermal CVD. The p-CVD process can use frequency bands of an RF band, VHF band, and UHF band. Each of the layers described above can be made by well-known apparatuses and film formation techniques. In the present embodiment, the thickness of the photoconductive layer 23 is appropriately determined in consideration of that desired electrophotographic characteristics are obtainable, capacitance in use can be within a desired range, and economic effects are achievable. The thickness of the photoconductive layer 23 can be 20 μm to 50 μm.

In FIGS. 2A to 2F, reference numeral 26 represents a free surface.

Suppression of Image Density Irregularities

A process for suppressing image-density irregularities in the present embodiment will now be described below.

In operation of the image forming apparatus, uneven temperature distribution may occur inside a machine by unbalanced arrangement of heat sources, such as the fixing device 8 and motor, and airflow.

The present embodiment can form an excellent image whose image-density irregularities are suppressed even when unevenness in temperature is present inside the image forming apparatus. The present embodiment can omit or simplify a temperature control device, such as a heater, to maintain the temperature of the photo conductor constant.

Figure 10:
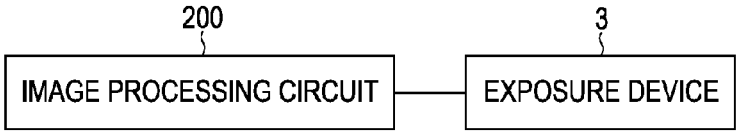
FIG. 10 is a block diagram of a process for correcting an exposure condition.

In the present embodiment, to avoid unevenness in charging caused by a difference in potential decay characteristic across the entire surface of the photosensitive drum 1 (a-Si photo conductor), in turn, image-density irregularities, as illustrated in FIG. 10, the exposure conditions for exposure performed by the exposure device 3 are changed by an image processing circuit 200. In the present embodiment, the exposure conditions are changed by modulating the pulse width of a signal to be input to the exposure device. Typically, a great pulse width corresponds to a large amount of exposure dose per unit area, and a narrow pulse width corresponds to a small amount of exposure dose per unit area. Another way of changing the exposure conditions is to change the exposure dose per unit area by increasing laser power by modulating the intensity of the exposure. In the present embodiment, two or more temperature measuring devices are disposed inside the main body A of the apparatus, and the exposure conditions are corrected based on the temperature distribution inside the main body A of the apparatus.

In the present embodiment, the image forming apparatus 100 includes the photosensitive drum 1, which is an image bearing member that has a movable surface having a photoconductive layer, and the charging device 2, which charges the surface of the photosensitive drum 1. In the present embodiment, a corona charger is used as the charging device 2. The image forming apparatus 100 includes the exposure device 3 as an exposure unit configured to expose the charged surface of the photosensitive drum 1 and to form an electrostatic latent image thereon and the image processing circuit 200 as a control unit configured to control the exposure performed by the exposure device 3 in accordance with image information. The image processing circuit 200 as the control device generates exposure data based on the image information. The image forming apparatus 100 includes the developing device 4 as a developing unit configured to attach toner to the electrostatic latent image and to develop it as a toner image and a transferring unit configured to transfer the toner image from the photosensitive drum 1 to another member. The image forming apparatus 100 includes a memory chip 300 (FIGS. 4A and 4B) as a storage unit that stores a temperature characteristic of the surface potential of the photosensitive drum 1. The temperature characteristic of the surface potential is typically the amount of change in the surface potential per unit temperature. The longitudinal direction of the photosensitive drum 1 is typically a direction transverse to (substantially perpendicular to) the direction of movement of the surface of the photosensitive drum 1 (rotational direction thereof) and is typically a main scanning direction in optical scanning of the exposure device 3.

The exposure conditions during exposure of the exposure device 3 can be changed in accordance with the temperature characteristic stored in the memory chip 300. For an a-Si based photo conductor, even in the same exposure conditions (the same exposure dose per unit area), when the temperature of the photo conductor increases by 1° C., the exposure potential (potential of the photosensitive drum at the exposure position after exposure) decreases by approximately 2-3 V. The memory chip 300 has a control table that controls the exposure conditions such that the exposure potential is increased by approximately 2-3 V for every 1° C. rise in temperature of the photo conductor. The image forming apparatus 100 includes the temperature sensor 12 as a temperature measuring device capable of measuring temperatures in two different locations in the longitudinal direction of the photosensitive drum 1 to measure temperature inside the main body A of the apparatus correlated with the surface temperature of the photosensitive drum 1. In the present embodiment, two temperature sensors 12A and 12B are included as the temperature sensor 12. The image processing circuit 200 changes the exposure conditions for exposure performed by the exposure device 3 based on measured values measured by these two temperature sensors 12 and the potential decay characteristic table. The details will be described below.

In the present embodiment, to suppress image-density irregularities resulting from temperature dependence of the potential decay characteristics of the photosensitive drum 1, the exposure conditions are corrected based on temperature distribution inside (within the machine of) the main body A of the apparatus.

Figure 3:
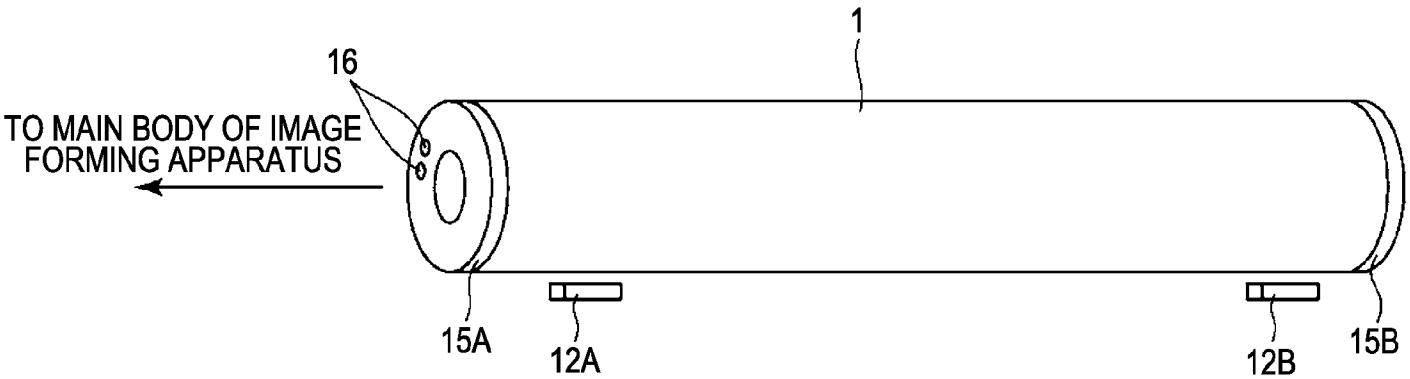
FIG. 3 is a schematic perspective view of an example of a photosensitive drum and its surroundings.

As described above, in the present embodiment, the plurality of temperature sensors 12 as a temperature measuring device are arranged in different locations in the longitudinal direction of the photosensitive drum 1 to measure temperatures of adjacent areas of the surface of the photosensitive drum 1. In the present embodiment, as illustrated in FIG. 3, the two temperature sensors are arranged such that the first temperature sensor 12A is disposed adjacent to an end of the photosensitive drum 1 corresponding to the rear side of the main body A (the end is the leading end when the photosensitive drum 1 is mounted in the main body A of the apparatus) and the second temperature sensor 12B is disposed adjacent to the other front-side end.

More specifically, in the present embodiment, as the first and second temperature sensors 12A and 12B, a thermocouple (or, for example, thermistors) capable of measuring the temperature of an atmosphere near the surface of the photosensitive drum 1 is used. The length of the photosensitive drum 1 in the longitudinal direction is approximately 380 mm, whereas the first temperature sensor 12A is located approximately 30 mm away from the rear end of the photosensitive drum 1 and the second temperature sensor 12B is located approximately 30 mm away from the front end of the photosensitive drum 1. The distance between the photosensitive drum 1 and each of the first and second temperature sensors 12A and 12B is approximately 5 mm.

The arrangement of the temperature sensors 12 is not limited to the above. The temperature sensors 12 can have any structure and be placed in any location as long as they can measure temperature variations of the main body of the image forming apparatus, the unevenness in temperature affecting the potential decay characteristics of the photosensitive drum 1, with a desired accuracy. In other words, the temperature sensors 12 can have a structure and be arranged so as to measure temperature of the inside of the main body A of the apparatus, the temperature being correlated with the surface temperature of the photosensitive drum 1 affecting the potential decay characteristics of the photosensitive drum 1. For example, the temperature sensors 12 may be arranged in a location slightly displaced from the photosensitive drum 1, instead of being arranged immediately above the photosensitive drum 1.

As the temperature of adjacent area of the surface of the photosensitive drum 1, for example, the temperature of a region 5 mm to 20 mm away from the surface of the photosensitive drum 1 can be measured. Moreover, the temperature of a region 10 mm or less away from the surface of the photosensitive drum 1 can be measured. The temperature of the surface of the photosensitive drum 1 can also be measured in a non-contact manner using an infrared temperature measuring device or other devices. If the surface of the photosensitive drum 1 can be measured without damage to the photosensitive drum 1, directly measuring the surface temperature leads to more accurate control. In this case, a non-contact temperature measuring device, as described above, can be used.

Figure 16:
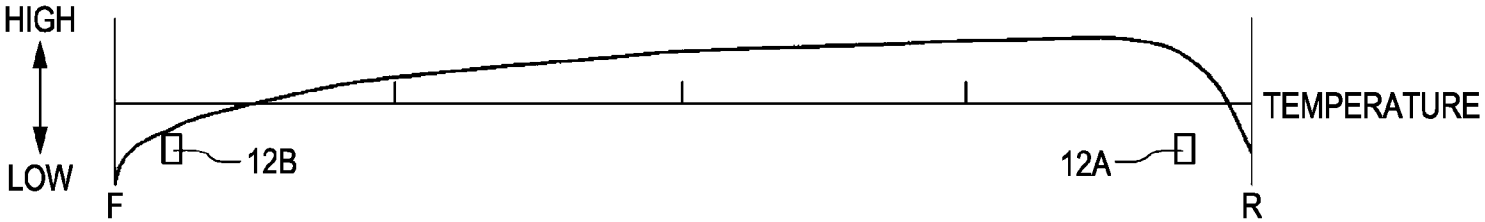
FIG. 16 is a graph that shows an example of temperature distribution in the vicinity of the surface of the photosensitive drum.

The relationship between potential decay characteristics and temperatures of the photo conductor is obtained as a characteristic of the photo conductor by actual measurement. In the photo conductor used in the present embodiment, when the temperature of the photo conductor decreases by approximately 1° C., the exposure potential decreases by approximately 3 V. FIG. 16 shows one example of an arrangement of the first and second temperature sensors 12A and 12B and temperature distribution in adjacent areas of the surface of the photosensitive drum 1. The state in FIG. 16 is that the temperature adjacent to the first temperature sensor 12A is higher than the temperature adjacent to the second temperature sensor 12B. When such temperature distribution is present, even if exposure is performed under the same exposure conditions, the potential of a region adjacent to the first temperature sensor 12A tends to decrease, whereas the potential of a region adjacent to the second temperature sensor 12B is less prone to decrease. To address this, when the temperature of the photo conductor is approximately 1° C. higher than a reference temperature, the exposure dose is reduced to a value at which the exposure potential of the photosensitive drum 1 is increased by 3 V when exposure is performed at the reference temperature.

Figure 17:
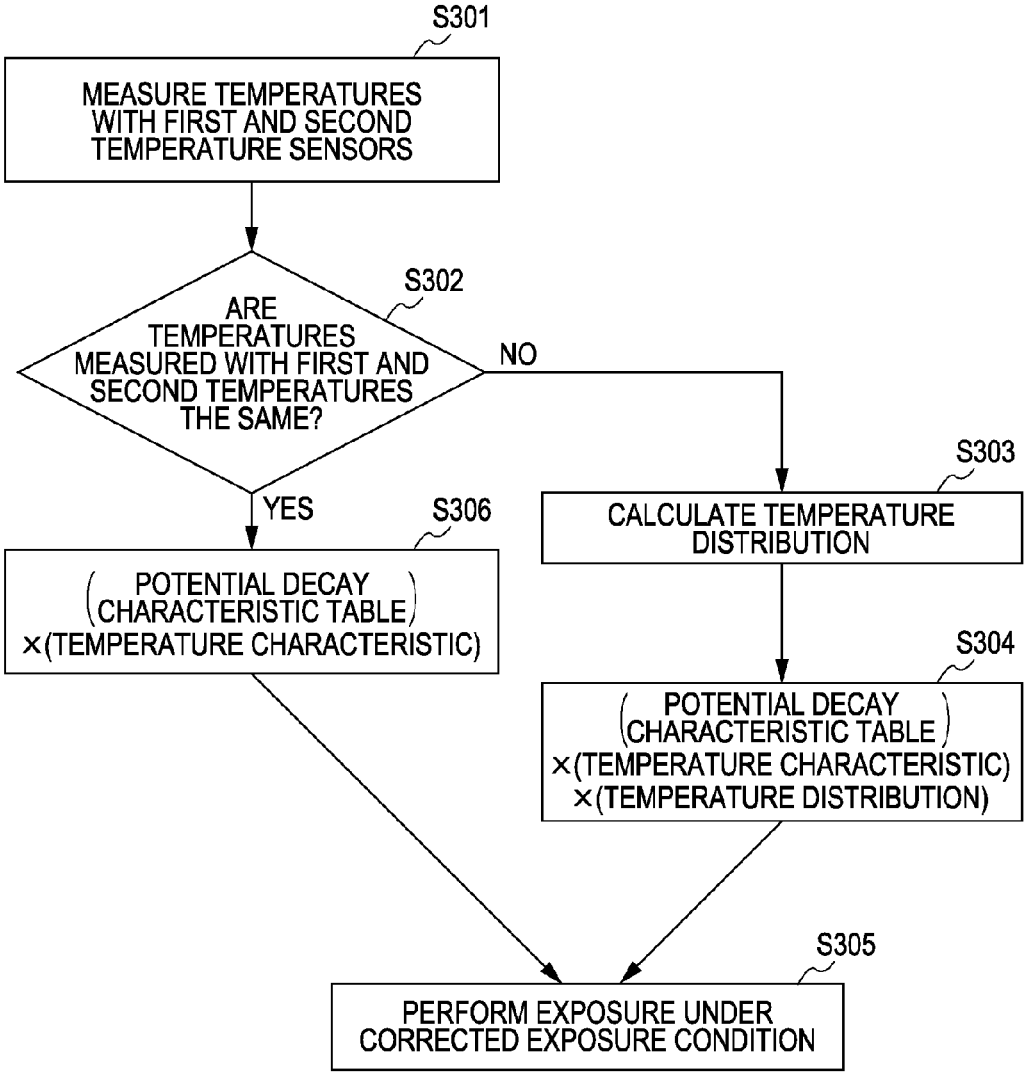
FIG. 17 is a flowchart of a process for controlling an exposure condition according to the first embodiment.

A flowchart of a process for controlling the exposure conditions in consideration of unevenness in temperature is shown in FIG. 17.

In step S301, the image processing circuit 200 reads results of measurement performed by the first and second temperature sensors 12A and 12B. Then, in step S302, the image processing circuit 200 determines whether the temperatures measured by the first and second temperature sensors 12A and 12B are the same.

When the image processing circuit 200 determines that the temperatures measured by the first and second temperature sensors 12A and 12B are different (NO in step S302), flow proceeds to step S303. In step S303, temperature distribution inside the main body A of the apparatus, more specifically, temperature distribution in adjacent areas of the surface of the photosensitive drum 1 in the longitudinal direction of the photosensitive drum 1 is calculated.

In step S304, the image processing circuit 200 corrects the exposure conditions in the longitudinal direction of the photosensitive drum 1 based on temperature characteristics of the surface potential of the photosensitive drum 1 and the calculated temperature distribution inside the main body A of the apparatus. In step S305, exposure is performed based on image information and the exposure conditions corrected using the temperature sensors.

When the image processing circuit 200 determines that the temperatures measured by the first and second temperature sensors 12A and 12B are the same (YES in step S302), the following process is performed. That is, in this case, it is determined that temperature distribution inside the main body A of the apparatus, more specifically, temperature distribution in adjacent areas of the surface of the photosensitive drum 1 in the longitudinal direction of the photosensitive drum 1 is substantially uniform. Thus, in step S306, the exposure conditions in the longitudinal direction of the photosensitive drum 1 are corrected based on the temperature characteristic of the surface potential of the photosensitive drum 1. In step S305, exposure is performed based on image information and the exposure conditions corrected using the temperature sensors.

The present embodiment is particularly useful for an image forming apparatus that does not include a heater for controlling temperature (temperature control device) disposed inside the photosensitive drum 1. That is, according to the present embodiment, a temperature control unit for maintaining the temperature of the photosensitive drum 1 constant, such as a heater, can be omitted or simplified, thus resulting in cost reduction. In addition, it is not necessary to supply power to a heater, so the image forming apparatus is energy-saving. However, even if the photosensitive drum 1 is controlled by a heater so as to be maintained at a constant temperature, when uneven temperature distribution arising from the location of a heat source or the like is present in the longitudinal direction of the photosensitive drum 1, advantages of the present embodiment are obtainable. When the temperature of the photosensitive drum 1 is maintained at a constant temperature using a heater, it is advantageous in that changes in sensitivity dependent on temperature can be stabilized and image defects caused by discharge products produced in charging can be avoided. One specific structure of the temperature control device is a sheet heater arranged within the photosensitive drum 1 and configured to radiate heat from the inside of the photosensitive drum 1 through the cylinder to control the temperature. The temperature of the photosensitive drum 1 can also be controlled by the application of heat from an external heat source to a shaft that fixes the photosensitive drum 1. According to the present embodiment, even if unevenness in temperature is present inside the image forming apparatus, an excellent image whose image-density irregularities are suppressed can be formed.

Second Embodiment

In the first embodiment, the apparatus that employs the photosensitive drum 1 in which, when the temperatures are the same in the longitudinal direction thereof, the potential decay characteristics in the longitudinal direction are substantially the same is described. A second embodiment is suitably used in the photosensitive drum 1 in which, even when the temperatures are the same in the longitudinal direction thereof, the potential decay characteristics are different in the longitudinal direction. A characteristic of the second embodiment is that the apparatus includes the memory chip 300 (FIGS. 4A and 4B) as a storage unit that stores a potential decay characteristic table that indicates the potential decay characteristic for each of regions in which the surface of the photosensitive drum 1 is divided at least in the longitudinal direction thereof. In the potential decay characteristic table, information regarding the decay characteristics of the surface potential of the photosensitive drum 1 is stored. The other configurations in the image forming apparatus are fundamentally the same as the image forming apparatus in the first embodiment.

The a-Si photo conductor is produced by a process of making gas into a plasma with high-frequency waves or microwaves and solidifying it, and then depositing it on an aluminum cylinder to form a film. It is difficult to uniformize the plasma or place the aluminum cylinder in the center of the plasma, and it may be impossible to make the film forming conditions uniform with high precision over the entire area of the surface of the photo conductor. For this reason, a problem may occur in which unevenness in potential of the order of approximately 20 V in the entire area of the surface of the photo conductor is present in the development position, and this unevenness in potential may cause image-density irregularities.

This unevenness in potential is typically caused by (1) a difference in the charging performance arising from a difference in capacitance resulting from unevenness in film thickness in film formation and (2) a difference in potential decay characteristic arising from a local difference in film quality resulting from uneven film states or the like.

Even in a dark state, the potential decay after the completion of charging when the a-Si photo conductor is used is significantly larger than that occurring when the organic photo conductor is used. In addition, the potential decay is increased by an optical memory in image exposure. Therefore, to cancel an optical memory involved in the preceding image exposure, it may be necessary to perform a pre-exposure before charging.

The optical memory will be described here. When the a-Si photo conductor is charged and image exposure is performed, photocarriers are produced and the potential is decayed. At this time, however, the a-Si photo conductor has many dangling bonds (unconnected bonds), and they become a localized level and trap a portion of the photocarriers, thereby reducing the running property or reducing the possibility of recombination of photogenerated carriers. As a result, in an image forming process, a portion of photocarriers produced by exposure is liberated from the localized level simultaneously with the application of an electric field to the a-Si photo conductor in charging in the next charging step. A difference of the surface potential arises between an exposed region and an unexposed region, and it results in an optical memory.

To address this, it is common to make photocarriers latent inside the a-Si photo conductor excessive so as to have uniform potential over the entire surface by performing uniform exposure using an exposing device before charging to erase an optical memory. At this time, an optical memory (ghost) can be erased more effectively by increasing the exposure dose for the pre-exposure emitted from the pre-exposure device or by using a wavelength in the pre-exposure near to the peak of the spectral sensitivity (approximately 680 nm to 700 nm) of the a-Si photo conductor.

However, as described above, if unevenness in film thickness or a difference in potential decay characteristic resulting from a difference in film quality is present in the a-Si photo conductor, because electric fields applied between photoconductive layers are different, there is a difference in the liberation of photocarriers from the localized level. Therefore, even if the photo conductor is uniformly charged in the charge position, unevenness in potential occurs in the development position. In addition, it is disadvantageous in terms of charging performance because a region that has a smaller film thickness has a larger capacitance, and a reduction in charging performance makes unevenness in charging in the developing portion noticeable.

For the above reasons, potential decay between charging and development is significantly large, and the potential decay may be the order of approximately 100 V to 200V. At this time, the unevenness in film thickness and the difference in potential decay characteristic, as described above, may cause unevenness in potential of the order of approximately 10 V to 20 V in the entire surface of the photo conductor.

If this unevenness in potential occurs, the a-Si photo conductor having large capacitance is more affected than the organic photo conductor, because development contrast (difference between the potential in the exposed region and the development bias potential) is smaller, and image-density irregularities may be noticeable.

To solve the above problems, the assignee proposes an image forming apparatus that changes the exposure conditions in accordance with the potential decay characteristics of the surface of a photo conductor in Japanese Patent Laid-Open No. 2002-067387, corresponding to U.S. Pat. No. 6,466,244. In contrast to this known technique, the second embodiment changes the exposure conditions in consideration of, additionally, influence of temperature distribution in the longitudinal direction of the photo conductor.

An exemplary structure will be specifically described below. The image forming apparatus 100 includes the memory chip 300 (FIGS. 4A and 4B) as a storage unit that stores a potential decay characteristic table that indicates the potential decay characteristic for each of regions into which the surface of the photosensitive drum 1 is divided at least in the longitudinal direction thereof. The longitudinal direction of the photosensitive drum 1 is typically a direction transverse to (substantially perpendicular to) the direction of movement of the surface of the photosensitive drum 1 (rotational direction thereof) and is typically a main scanning direction in optical scanning of the exposure device 3. In the present embodiment, the memory chip 300 stores the potential decay characteristic table that indicates the potential decay characteristic for each of regions into which the surface of the photosensitive drum 1 is divided in the longitudinal direction thereof and in a direction transverse to (substantially perpendicular to) the longitudinal direction. The direction transverse to the longitudinal direction of the photosensitive drum 1 is typically the direction of movement of the surface of the photosensitive drum 1 (rotational direction thereof) and is typically a sub-scanning direction in optical scanning of the exposure device 3. That is, in the present embodiment, the image forming apparatus 100 includes the storage unit that stores the potential decay characteristic table that two-dimensionally represents the potential decay characteristics of the entire surface of the photosensitive drum 1.

The exposure conditions for exposure performed by the exposure device 3 can be changed in accordance with the potential decay characteristic table stored in the memory chip 300 and the temperature measured by the temperature sensor. More specifically, the image forming apparatus 100 includes the temperature sensor 12 as temperature measuring devices configured to measure the temperature of the inside of the main body A of the apparatus correlated with the surface temperature of the photosensitive drum 1 and disposed in at least two different locations in the longitudinal direction of the photosensitive drum 1. In the present embodiment, two or more temperature sensors 12 as the temperature measuring devices configured to measure the temperature of adjacent areas of the surface of the photosensitive drum 1 are disposed in the longitudinal direction of the photosensitive drum 1. The image processing circuit 200 corrects the potential decay characteristic table based on measured values obtained by the at least two temperature sensors 12 and changes the exposure conditions for exposure performed by the exposure device 3 based on the corrected potential decay characteristic table. The details will be described below in further detail.

Basic Operation of Process for Suppressing Image-Density Irregularities

For the photosensitive drum 1 being an a-Si photo conductor used in the present embodiment, in the manufacture of photosensitive drums 1, a potential decay characteristic is determined for each of the photosensitive drums 1, and the potential decay characteristic is held by the photosensitive drum 1 as a characteristic table, i.e., a potential decay characteristic table. The potential decay characteristic table can be obtained by measurement of a surface potential of each of the photosensitive drums 1 in the development position after the surface of the photosensitive drum 1 is charged and then exposed by the exposure device 3 in the exposure position with a predetermined amount of light.

More specifically, the above potential decay characteristic table is described below. The entire surface of the photosensitive drum 1 is divided into appropriate regions according to a recording resolution in the main scanning direction (longitudinal direction of the photo conductor) and in the sub-scanning direction (rotational direction of the photo conductor) in optical scanning of the exposure device 3. Based on the potential decay for each of the regions, i.e., data of the surface potential measured in the development position after charging and then exposing with a predetermined amount of light, the overall potential decay characteristic map is created.

One example of the above division of the appropriate regions is division of the entire surface of the photosensitive drum 1 into regions each having a maximum size of approximately 10 mm×10 mm. In the present embodiment, the recording resolution of the image forming apparatus 100 is 600 dpi, and the surface of the photosensitive drum 1 is divided into 8,000 pixels in the main scanning direction. These pixels are divided into 32 regions, so one region has 250 pixels. The surface in the sub-scanning direction is divided into the same number of pixels. Accordingly, one region has a size of 250×250 pixels (=10.575 mm×10.575 mm).

The creation of such a potential decay characteristic table constituting the potential decay characteristic map about the surface of the photosensitive drum 1 need not necessarily be performed in such a way that the photosensitive drum 1 is actually attached into the main body A of the apparatus. For example, before the photosensitive drum 1 is incorporated into the main body A of the apparatus, the potential decay characteristics of the photosensitive drum 1 measured using an appropriate jig that has a potential sensor may be stored in the memory chip 300 of the photosensitive drum 1.

The data of the potential decay characteristic table stored in the memory chip 300 is read by the image processing circuit 200 as a control device (control unit) of the main body A of the apparatus when the photosensitive drum 1 is attached in the main body A of the apparatus. The image processing circuit 200 is a control device (control unit) that includes a central processing unit (CPU) that has an arithmetic portion, a control portion, and a storage portion. The image processing circuit 200 changes the exposure condition for exposure performed by the exposure device 3 for each of the regions stored in the potential decay characteristic table so as to have a uniform surface potential in the development position in accordance with the read data of each region in the potential decay characteristic table. In the present embodiment, as described above, the exposure device 3 uses a laser.

In the present embodiment, the potential decay characteristic table about the surface of the photosensitive drum 1 is associated with the actual surface of the photosensitive drum 1 in a manner described below. A contact for transmitting data from the memory chip 300 storing the data to the main body A of the apparatus (described below) is used as the reference such that the contact lies in a predetermined location whenever the photosensitive drum 1 rests.

More specifically, as illustrated in FIG. 3, the photosensitive drum 1 being the a-Si photo conductor is provided with first and second flanges 15A and 15B at the opposite ends in the longitudinal direction (the direction of an axis of rotation). The first flange 15A is disposed on the leading end of the photosensitive drum 1 being mounted in the main body A of the apparatus, and a contact 16 connected to the memory chip 300 inside the photosensitive drum 1 is disposed on this first flange 15A. The main body A of the apparatus, more specifically, the image processing circuit 200 reads data about the charging characteristics (potential decay characteristics) of the photosensitive drum 1 mounted in the main body A of the apparatus, from the memory chip 300 through the contact 16. The contact 16 also serves as a unit configured to detect position information.

Figure 4A:
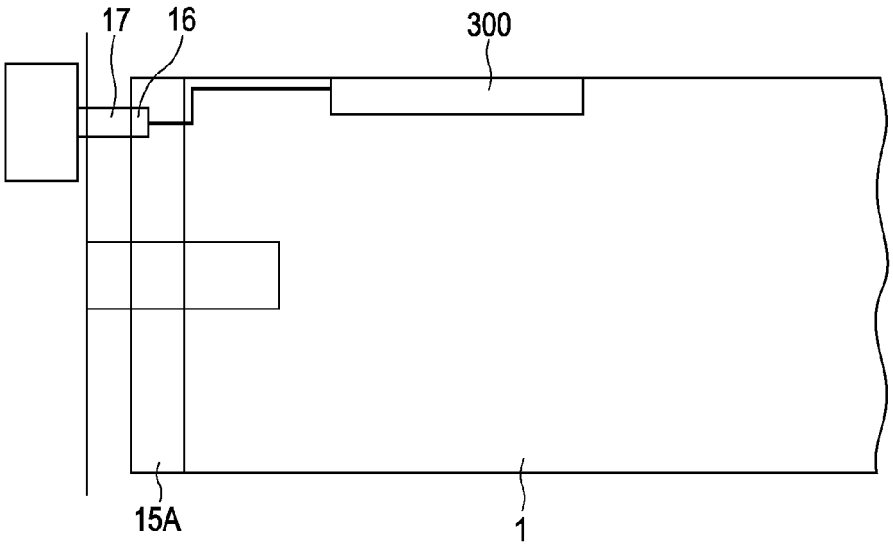
FIG. 4A is a vertical sectional view that illustrates a state in which a contact of the resting photosensitive drum is connected to a pin of a main body of the image forming apparatus.
Figure 4B:
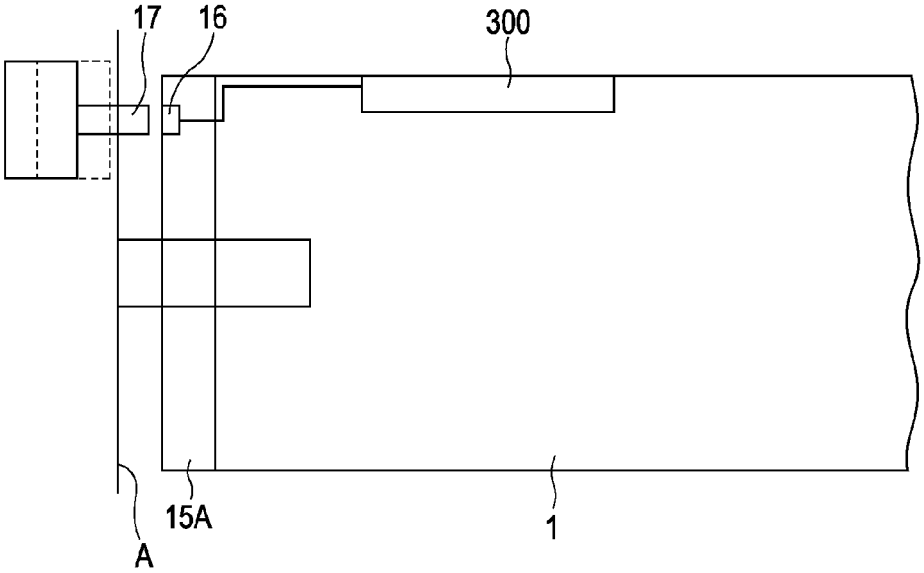
FIG. 4B is a vertical sectional view that illustrates a state in which the pin is detached from the contact and the photosensitive drum is rotatable.

A process for detecting the position information in the present embodiment is described below. FIG. 4A illustrates a state in which the photosensitive drum 1 rests. In this state, a memory-data reading pin 17 as a reading unit provided in the main body A of the apparatus is fixed while being pressed (urged) against the contact 16 by an urging unit (not shown). In contrast, FIG. 4B illustrates a state in which the photosensitive drum 1 is driven. In this state, the pressing of the pin 17 against the contact 16 is released and the pin 17 is separated from the contact 16, so the photosensitive drum 1 is freely rotatable. To stop rotation of the photosensitive drum 1, the pin 17 is pressed and fixed to the contact 16 immediately before the photosensitive drum 1 is stopped, and then the photosensitive drum 1 is stopped. In this way, the contact 16 functions as a datum-point detecting unit configured to detect the datum point of the photosensitive drum 1. In particular, in the present embodiment, the position information about the rotational direction of the photosensitive drum 1 can be detected by the contact 16 serving as the datum-point detecting unit.

The present embodiment uses a process for making the pin 17 be in contact with the contact 16 as the process for detecting the datum point of the photosensitive drum 1 and reading information from the memory chip 300. However, a control process through radio communication using an antenna substrate can also be employed (see a fourth embodiment).

A correspondence between regions defined on the surface of the photosensitive drum 1 and image data divided into regions will now be described below with reference to FIG. 5.

Figure 5:
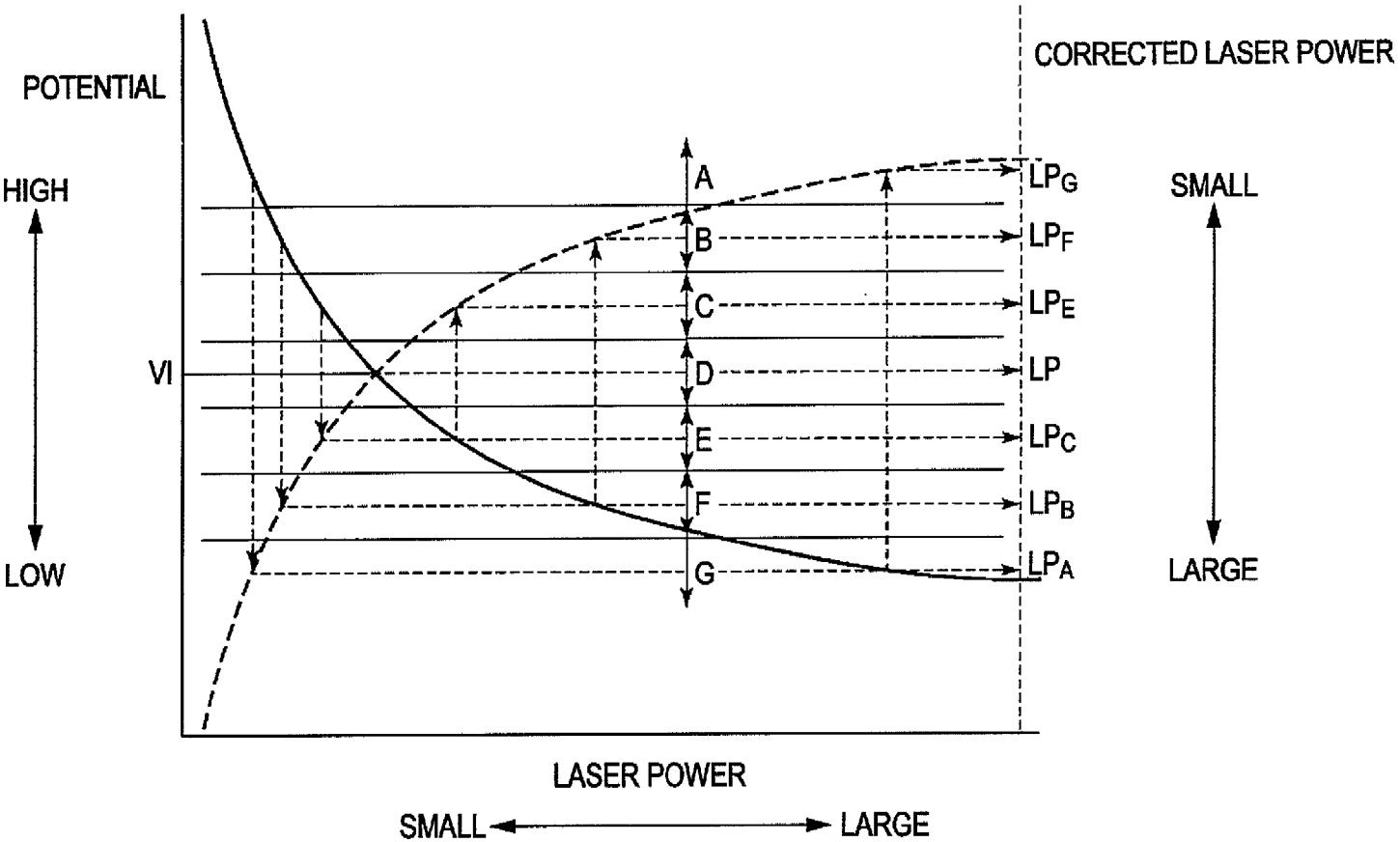
FIG. 5 is a graph of a relation between an exposure condition of the photo conductor and a potential (EV curve).

In FIG. 5, the horizontal axis represents the exposure dose (laser power), and the vertical axis represents the surface potential of the photosensitive drum 1. The solid-line curve in FIG. 5 indicates a graph that shows the relationship between the exposure dose and potential of exposure to the photosensitive drum 1 in use (EV curve). The broken-line curve in FIG. 5 is the reflection of the solid-line graph across the line y=V1.

In FIG. 5, the potential is divided into ranges A to G based on the EV curve. In FIG. 5, the value of a desired exposure potential is V1. The exposure condition being the reference is LP. In this state, an exposure potential is measured for each of the regions of the photosensitive drum 1 when exposure is performed under the exposure condition LP, and it is determined which of the ranges A to G the measured exposure potential corresponds to. For example, when the exposure potential of a certain region lies in the range D (V1±3 V), the exposure potential when exposure is performed under the exposure condition LP is approximately V1. However, when the exposure potential of a certain region lies in the range B (when the potential tends not to decrease through exposure), if exposure is performed under the exposure condition LP, the exposure potential in the certain region does not decrease relative to the range D, which is described above. Therefore, there is a potential difference between the exposure potential of the region corresponding to the range D and that of the region corresponding to the range B, so the image density varies. To address this, the exposure conditions for regions that tend not to decrease through exposure, like in ranges A, B, C, are set at exposure conditions larger than the exposure condition LP being the reference, whereas the exposure conditions for regions that tend to decrease through exposure, like in ranges E, F, G, are set at exposure conditions smaller than the exposure condition LP being the reference. For example, the exposure conditions for the regions corresponding to the ranges A, B, and C are set at $LP_A$, $LP_B$, and $LP_C$, respectively, whereas the exposure conditions for the regions corresponding to the ranges E, F, and G are set at $LP_E$, $LP_E$, and $LP_G$, respectively. In such a way, by using the exposure dose varying according to the characteristic of each of the regions of the photosensitive drum 1, the exposure potentials of the regions of the photosensitive drum 1 are substantially the same even if the potential decay characteristics thereof are different. The potential decay characteristic in the exposure condition for each of the regions of the photosensitive drum 1 is stored in the memory chip 300 as the potential decay characteristic table.

Figure 6:
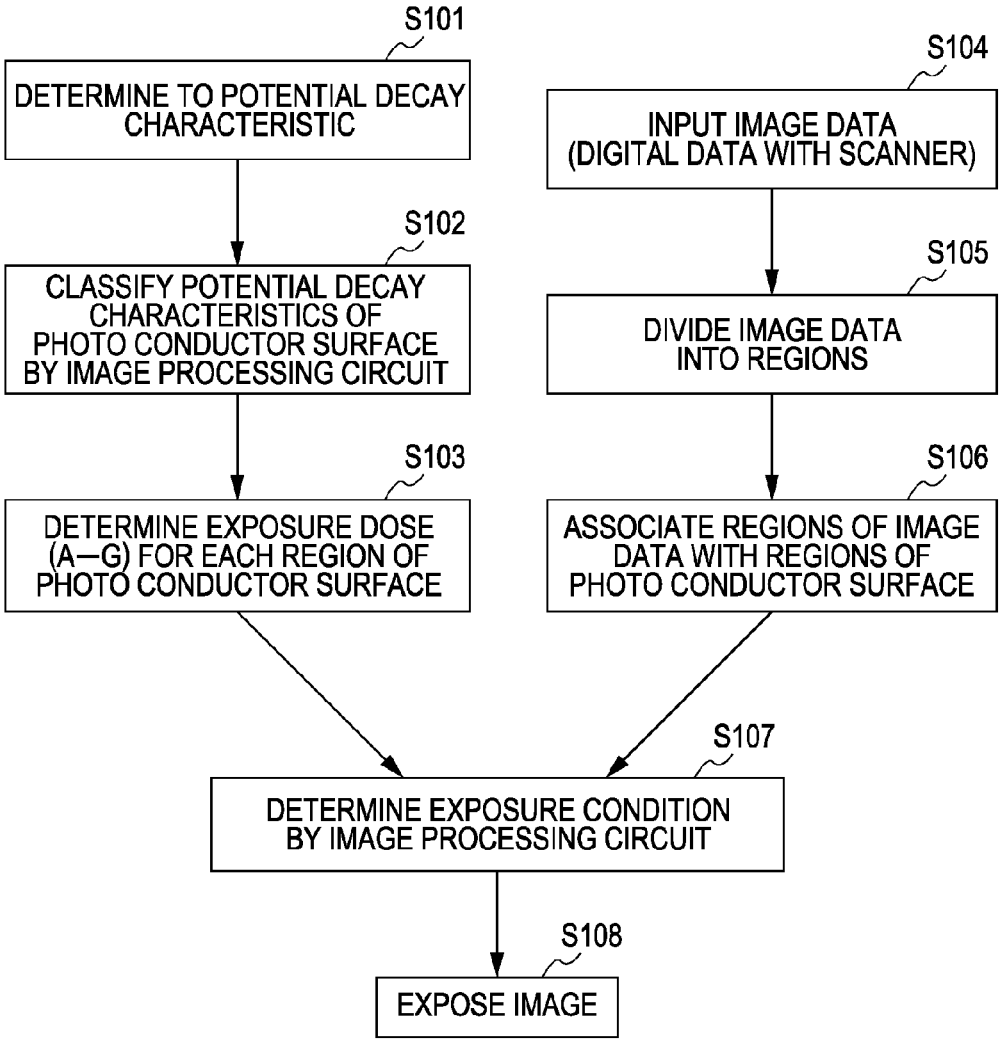
FIG. 6 is a flowchart of an image output process.

FIG. 6 shows a flow of outputting an image in the present embodiment.

Figure 7:
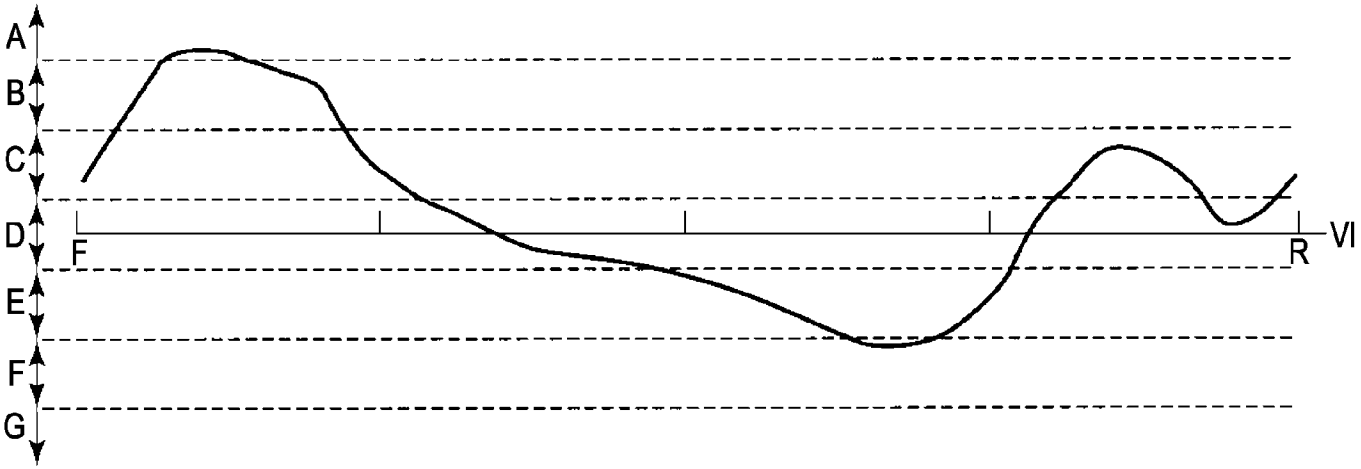
FIG. 7 is a graph that shows an example of potential distribution in a surface of the photosensitive drum after the surface is exposed.

First, in step S101, by referring to the potential decay characteristic table stored in the memory chip 300, it is determined which of the ranges A to G each of the regions of the surface of the photosensitive drum 1 corresponds to. In the present embodiment, a predetermined potential V1 is set at −80 V, and the regions are classified into the ranges A to G depending on the displacement of the potential of each of the regions of the photosensitive drum 1 from the potential V1 when exposure is performed under the exposure condition LP. More specifically, in the present embodiment, values of the surface potential of the photosensitive drum 1 are classified into eight levels A to G at intervals of 6 V from the set potential V1 as the center. One example of the exposure potential occurring when exposure is performed under the exposure condition LP being the reference is shown in FIG. 7, and it is determined which of the above-described ranges A to G each of the regions of the surface of the photosensitive drum 1 corresponds to. The curve in FIG. 7 represents distribution of the surface potential of the photosensitive drum 1 after the exposure in, for example, the main scanning direction of scanning performed by the exposure device 3. Distribution of the surface potential after the exposure in the sub-scanning direction can also be represented in a similar manner, and it can also be determined which of the ranges A to G each of the regions corresponds to. The ranges A to G are defined as follows:

$$(V1+15V)\leq A \quad \text{A}$$

$$(V1+9V)\leq B<(V1+15V) \quad \text{B}$$

$$(V1+3V)\leq C<(V1+9V) \quad \text{C}$$

$$(V1-3V)\leq D<(V1+3V) \quad \text{D}$$

$$(V1-9V)\leq E<(V1-3V) \quad \text{E}$$

$$(V1-15V)\leq F<(V1-9V) \quad \text{F}$$

$$(V1-15V)>G \quad \text{G}$$

Figure 8:
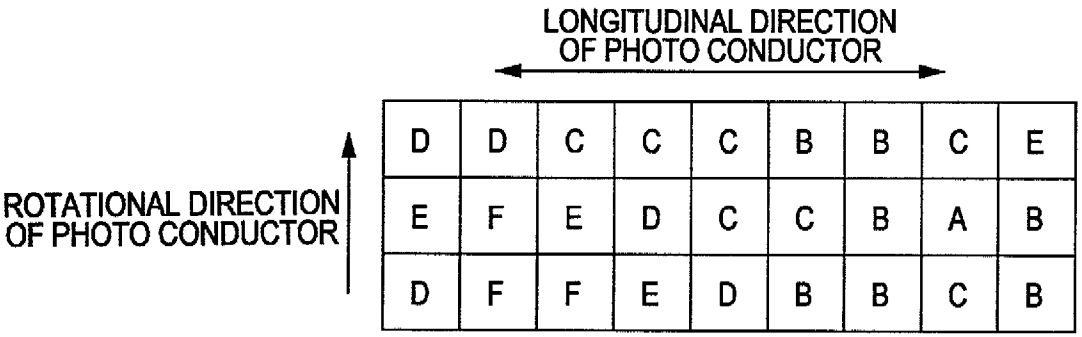
FIG. 8 is a schematic diagram of potentials of a plurality of regions of the surface of the photosensitive drum after the surface is exposed.

In accordance with the above levels, is step S102, the image processing circuit 200 performs classification of the regions of the entire surface of the photosensitive drum 1 into the ranges A to G, as illustrated in FIG. 8. In step S103, the image processing circuit 200 sets the exposure conditions for exposure performed by the exposure device 3 at eight levels such that the exposure potential of each of the regions of the surface of the photosensitive drum 1 is present in the range D (V1±3 V). The exposure conditions are changed depending on the classification into the ranges A to G, as previously described.

In steps S104 and S105, an image is input, the input image is divided into regions corresponding to the regions into which the surface of the photosensitive drum 1 is divided, and the image is subjected to image processing.

In step S106, the regions of the surface of the photosensitive drum 1 are associated with the regions of the processed input image. In step S107, the exposure condition for exposure of the image for each of the regions is determined (the exposure condition is applicable to both a pulse-width modulation and an intensity modulation). In step S108, image exposure is performed based on the determined amount of laser light. In known techniques, exposure is performed based on the potential decay characteristic table of the photosensitive drum 1 in the above-described manner. In the present embodiment, in addition to this, as in "Correction of Potential Decay Characteristic Table" described below, the potential decay characteristic table is corrected based on temperature distribution.

Figure 9:
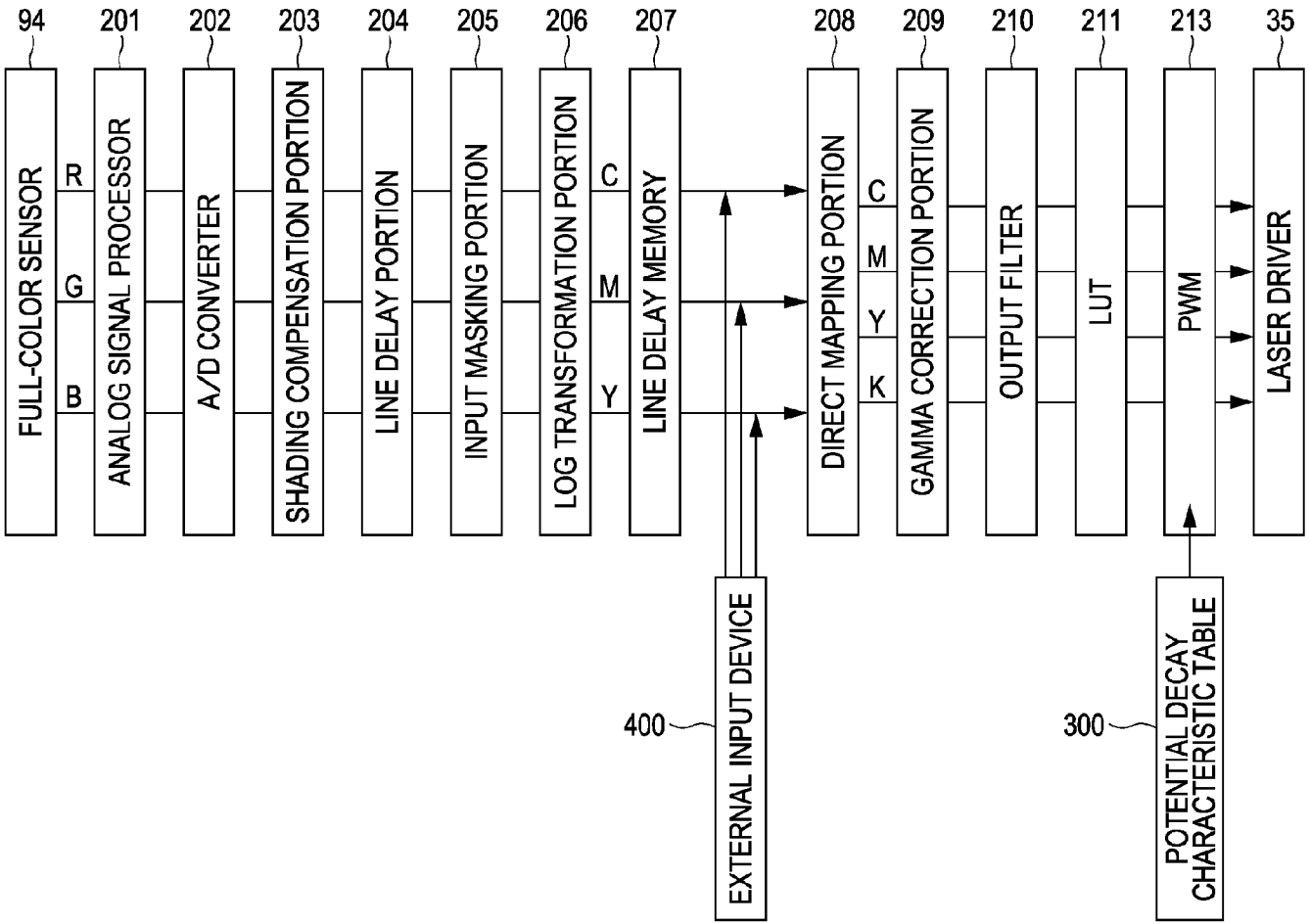
FIG. 9 is a block diagram for describing an example of image processing.

FIG. 9 is a block diagram for describing one example of image processing. An image signal output from the full-color sensor (CCD) 94 is input to an analog signal processor 201. The gain and/or offset of the image signal are adjusted by the analog signal processor 201. Then, the image signal is converted into an eight-bit RGB digital signal (256 levels of 0 to 255) for each color component by an analog-to-digital (A/D) converter 202. The image signal is subjected to publicly known shading compensation by a shading compensation portion 203. The shading compensation is performed using a signal obtained from reading of a reference white plate for each color by optimizing the gain for each individual cell to reduce sensitivity variations among a group of sensor cells aligned in a line of the CCD.

A line delay portion 204 corrects spatial displacement contained in the image signal output from the shading compensation portion 203. The spatial displacement is produced by arrangement in which line sensors of the full-color sensor 94 are spaced at intervals of a predetermined distance in the sub-scanning direction. More specifically, with reference to a color component B, a color component R signal and a color component G signal are line-delayed in the sub-scanning direction such that the phases of the three color component signals are synchronized to each other.

An input masking portion 205 transforms a color space of the image signals output from the line delay portion 204 into an NTSC standard color space by a matrix operation of the following equation (1). That is, a color space of the color component signals output from the full-color sensor 94, the color space being specified by spectral characteristics of a filter corresponding to each color component, is transformed into an NTSC standard color space.

$$\begin{bmatrix} Ro \\ Go \\ Bo \end{bmatrix} = \begin{bmatrix} a11 & a12 & a13 \\ a21 & a22 & a23 \\ a31 & a32 & a33 \end{bmatrix} \begin{bmatrix} Ri \\ Gi \\ Bi \end{bmatrix} \quad (1)$$

(Ro, Go, Bo: Output Image Signal
Ri, Gi, Bi: Input Image Signal)

A LOG transformation portion 206 includes a look-up table (LUT) stored in, for example, a read-only memory (ROM) or a random-access memory (RAM) and transforms the RGB luminance signals output from the input masking portion 205 into CMY density signals. A line delay memory 207 delays an image signal output from the LOG transformation portion 206 by a time period (line delay period) over which a black character discrimination portion (not shown) generates control signals, such as UCR, FILTER, and SEN, from the output of the input masking portion 205.

A direct mapping portion 208 outputs an image signal output from the line delay memory 207 as, for example, an eight-bit color component signal directly to a printer portion after referring to a three-dimensional LUT. The direct mapping portion 208 can also receive an image signal output from an external input device 400. In direct mapping, for example, by supplying L*a*b* or RGB three input signals, signal values required for reproducing the colors in an output color space are output as signals of four colors of yellow, magenta, cyan, and black. For this color transforming process, a matrix operation is not necessary and non-linear transformation is possible. Therefore, the degree of flexibility in color transformation, such as in setting of under color removal (UCR), is increased, and a desired color can be reproduce while at the same time the amount of toner application is controlled.

A gamma correction portion 209 performs density correction on an image signal output from the direct mapping portion 208 to adjust the image signal to an ideal gradation characteristic of the printer portion. An output filter (spatial filter processor) 210 performs edge enhancement or smoothing processing on an image signal output from the gamma correction portion 209 in accordance with a control signal from the CPU (not shown).

An LUT (LUT storage portion) 211 is configured to match the density of an output image with the density of an original image and is included in, for example, a RAM. The translation table is set by the CPU (not shown).

A pulse-width modulator (PWM) 213 outputs a pulse signal that has a pulse width corresponding to the level of an input image signal. The pulse signal is input to a laser driver 35 configured to drive the semiconductor laser element (laser oscillator) 31. Typically, a great pulse width corresponds to a large amount of exposure dose, and a narrow pulse width corresponds to a small amount of exposure dose.

In the present embodiment, the image processing circuit 200 includes the following components: the analog signal processor 201, the A/D converter 202, the shading compensation portion 203, the line delay portion 204, the input masking portion 205, the LOG transformation portion 206, the line delay memory 207, the direct mapping portion 208, the gamma correction portion 209, the output filter 210, the LUT (LUT storage portion) 211, and the pulse width modulator 213.

Various modes of an image processing method itself, including the above, are publicly known. In the present invention, any available method can be selected and applied as an image processing method itself.

In the present embodiment, the exposure conditions are corrected in accordance with the potential decay characteristics of each of the photosensitive drums 1 by correction of an output pulse width from the pulse width modulator (PWM) 213 using the potential decay characteristic table based on information stored in the memory chip 300.

In the present embodiment, the exposure conditions based on the potential decay characteristics of the photo conductor are adjusted by the foregoing algorithm. However, a process for correcting the exposure conditions is not limited to the above. Other correction processes, for example, correction of image data itself based on the potential decay characteristic table or correction of a laser look-up table, enable similar processing to be performed and similar advantages to be achieved.

Correction of Potential Decay Characteristic Table

In the present embodiment, in addition, to suppress image-density irregularities resulting from temperature dependence of the potential decay characteristics of the photosensitive drum 1, correction based on temperature distribution inside (within the machine of) the main body A of the apparatus (temperature compensation) is added to the foregoing potential decay characteristic table. Specific structures of a temperature measuring device and other parts are substantially the same as in the first embodiment, so the detailed description thereof is not repeated here.

Figure 11:
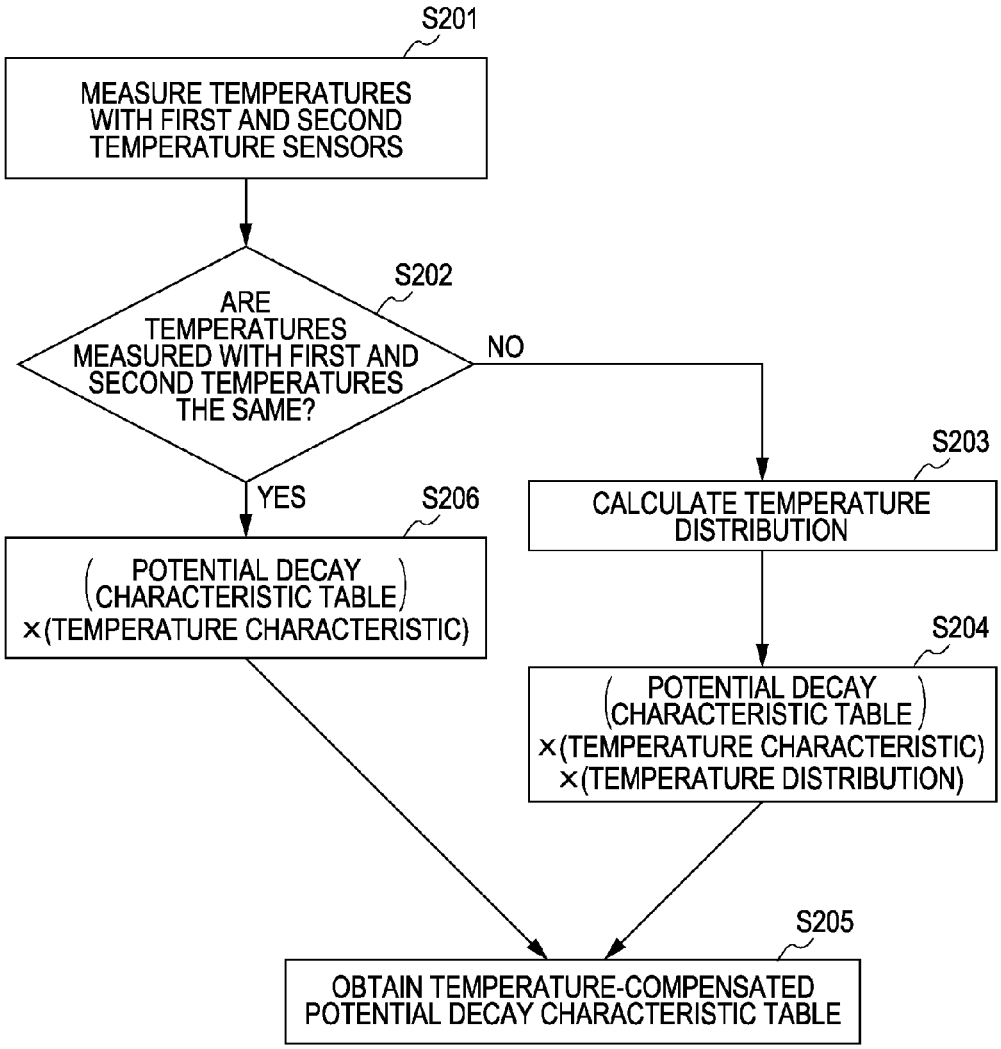
FIG. 11 is a flowchart of a process for correcting a potential decay characteristic table according to a second embodiment.

A flowchart of a process for correcting the potential decay characteristic table is shown in FIG. 11.

In step S201, the image processing circuit 200 reads results of measurement performed by the first and second temperature sensors 12A and 12B. Then, in step S202, the image processing circuit 200 determines whether the temperatures measured by the first and second temperature sensors 12A and 12B are the same.

When the image processing circuit 200 determines that the temperatures measured by the first and second temperature sensors 12A and 12B are different (NO in step S202), flow proceeds to step S203. In step S203, temperature distribution inside the main body A of the apparatus, more specifically, temperature distribution in adjacent areas of the surface of the photosensitive drum 1 in the longitudinal direction of the photosensitive drum 1 is calculated.

The image processing circuit 200 compensates for influence of unevenness in temperature of the inside of the main body A of the apparatus on the surface potential of the photosensitive drum 1 in a manner described below.

First, the image processing circuit 200 calculates a new temperature-compensated potential decay characteristic table based on the potential decay characteristic table stored in the memory chip 300, the temperature characteristics of the surface potential of the photosensitive drum 1, and the calculated temperature distribution inside the main body A of the apparatus (in step S204).

Then, the potential decay characteristics in the obtained new temperature-compensated potential decay characteristic table are set as the potential decay characteristics in step S101

(FIG. 6), the exposure correction process is performed, and an exposure is performed under the corrected exposure conditions (S205).

Figure 12:
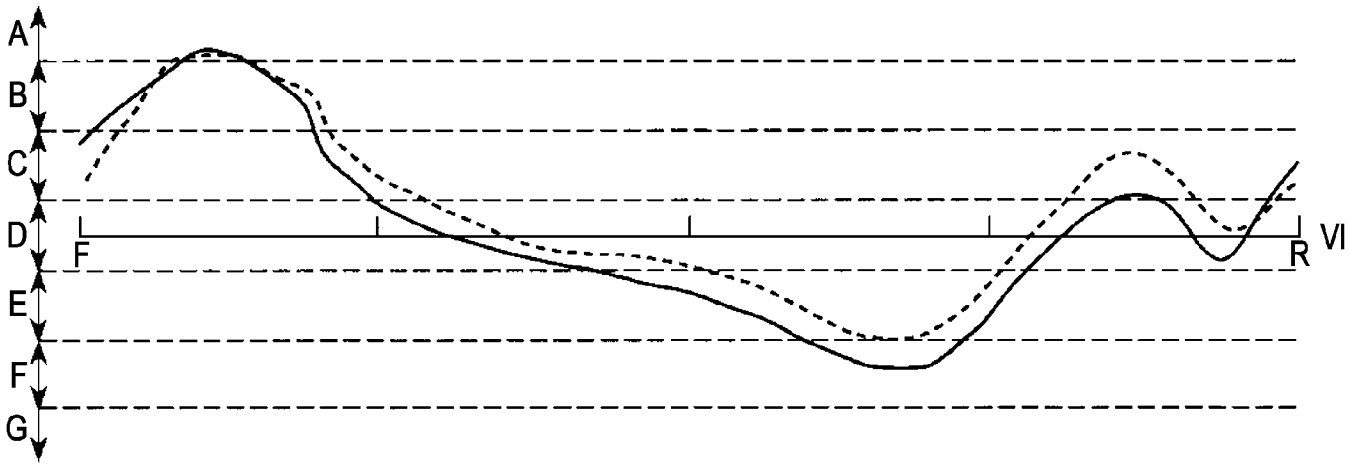
FIG. 12 is a graph that shows an example of distribution of the surface potential of the photosensitive drum after the surface is exposed.
Figure 13:
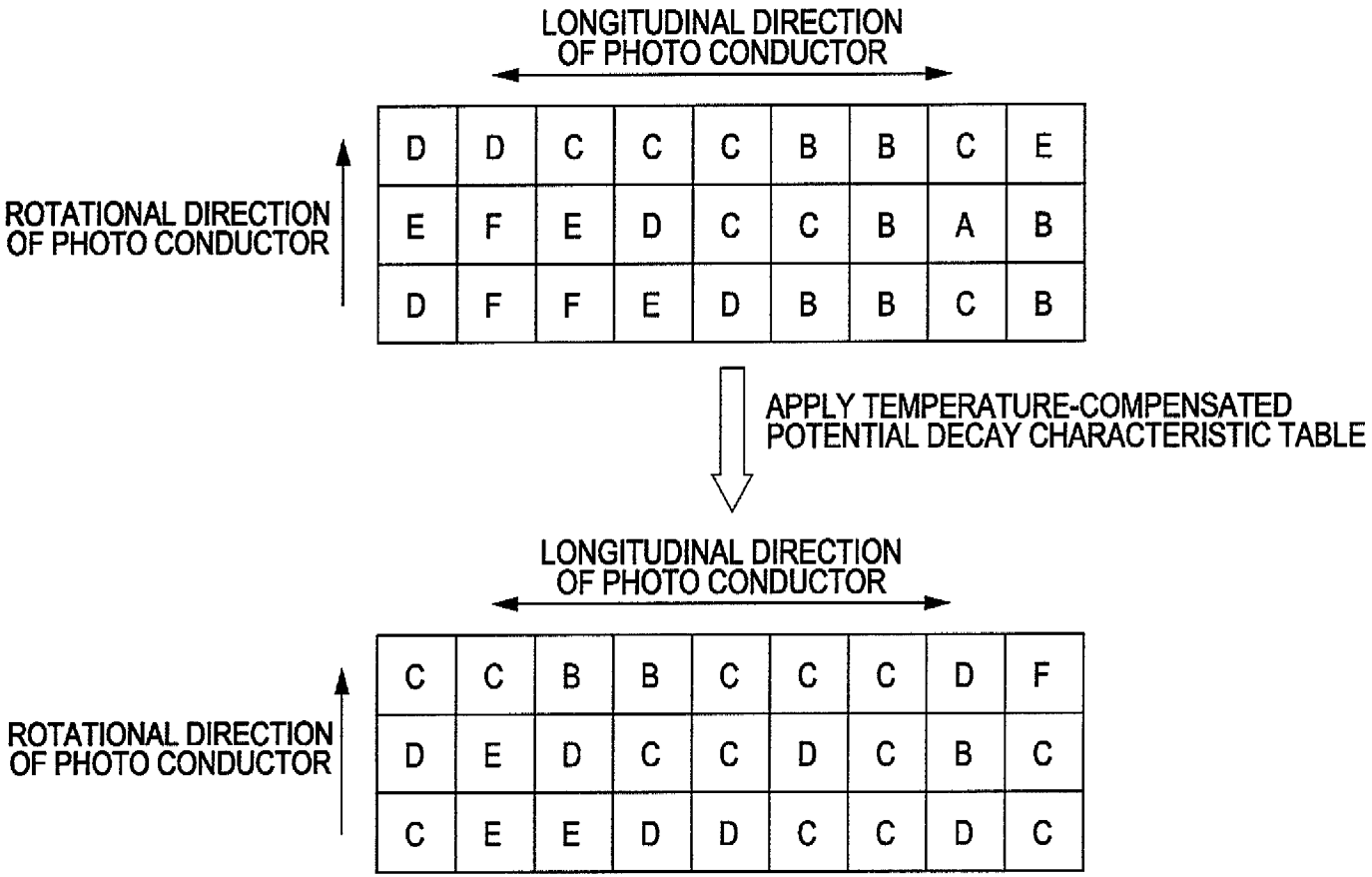
FIG. 13 is a schematic diagram of potentials of a plurality of regions of the surface of the photosensitive drum after the surface is exposed.

In FIG. 12, the solid-line curve represents one example of distribution of the surface potential of the photosensitive drum 1 in the longitudinal direction thereof after exposure in a state in which temperature distribution in the longitudinal direction of the photosensitive drum 1 is even. The broken-line curve in FIG. 12 represents one example of the exposure potential of the photosensitive drum 1 in a state in which uneven temperature distribution is present in the longitudinal direction of the photosensitive drum 1, and in this example, the surface potential of the photosensitive drum 1 is displaced from that indicated by the solid lines in some temperatures. The upper illustration in FIG. 13 shows a result of classification of the regions of the surface of the photosensitive drum 1 into A to G, described above, by referring to a previously set predetermined potential decay characteristic table at a reference temperature. The lower illustration in FIG. 13 shows the potential decay characteristic table obtained after the classification of the regions into A to G shown in the upper illustration of FIG. 13 is corrected based on the temperature characteristics. The correction based on the temperature characteristics is described below. The description is provided below using one example in which a photo conductor whose exposure potential decreases by 3 V with an increase in the temperature of the photo conductor by 1° C. is used. When V1=−80 V, the exposure potential is −80 V in a certain region at a reference temperature (42° C. in the present embodiment). In this case, the certain region is classified as D. When the temperature of the certain region becomes 46° C., because the difference from the reference temperature is 4° C., the exposure potential decreases by 12 V to −92 V. As a result, the certain region becomes F at 46° C. In such a manner, correction based on the temperature characteristic for each region is performed. As previously described, the exposure conditions for exposure performed by the exposure device 3 are corrected such that all the surface potentials of the regions classified into A to G in the development position after exposure (exposure potential) lie in D (V1±3 V). When uneven temperature distribution is present in the longitudinal direction of the photosensitive drum 1, correction based on the temperature characteristics in the longitudinal direction of the photosensitive drum 1 is applied to the potential decay characteristic table. By control of the exposure conditions based on the potential decay characteristic table shown in the lower illustration of FIG. 13, even when uneven temperature distribution is present in the longitudinal direction of the photosensitive drum 1, as indicated by the broken-line curve in FIG. 12, the exposure potential can lie in the range D in the longitudinal direction.

The temperature characteristic of the surface potential of the photosensitive drum 1 is typically the amount of change in the surface potential per unit temperature. For example, in the present embodiment, the exposure potential decreases by 3 V with an increase of 1° C. in temperature of the photo conductor. This temperature characteristic can be stored in a storage portion incorporated in or connected to the image processing circuit 200, such as a ROM, or can be stored in the memory chip 300. The calculated temperature-compensated potential decay characteristic table can be stored in a storage portion incorporated in or connected to the image processing circuit 200, such as a RAM. When required, this temperature-compensated potential decay characteristic table can be stored in the memory chip 300.

More specifically, the temperature-compensated potential decay characteristic table can be calculated in a manner described below. That is, the image processing circuit 200 calculates a temperature variation (temperature difference) from the reference temperature in generation of the potential decay characteristic table stored in the memory chip 300 (42° C. in the present embodiment) in each of the regions in the longitudinal direction of the photosensitive drum 1 from the determined temperature distribution. By multiplying the temperature difference in each region in the longitudinal direction of the photosensitive drum 1 and the temperature characteristic in the surface potential of the photosensitive drum 1 together, the value of the surface potential of each region in the development position shown in the potential decay characteristic table stored in the memory chip 300 is corrected. A new temperature-compensated potential decay characteristic table can be obtained by performing such correction on the entire area in the longitudinal direction (main scanning direction) and in the rotational direction (sub-scanning direction) in the potential decay characteristic table stored in the memory chip 300.

In step S202 of FIG. 11, when the image processing circuit 200 determines that the temperatures measured by the first and second temperature sensors 12A and 12B are the same (YES in step S202), the following process is performed. That is, in this case, it is determined that temperature distribution inside the main body A of the apparatus, more specifically, temperature distribution in adjacent areas of the surface of the photosensitive drum 1 in the longitudinal direction of the photosensitive drum 1 is substantially uniform. Therefore, the potential decay characteristic table stored in the memory chip 300 is corrected as described below. A temperature variation (temperature difference) between the reference temperature in generation of the potential decay characteristic table stored in the memory chip 300 and the temperatures measured by the first and second temperature sensors 12A and 12B is determined. By multiplying the temperature difference and the temperature characteristic of the surface potential of the photosensitive drum 1 together, the value of the surface potential of each of the regions in the development position shown in the potential decay characteristic table stored in the memory chip 300 is uniformly corrected (step S206).

Then, by use of the obtained new temperature-compensated potential decay characteristic table, as in the case of the above, the exposure correction process is performed, and an exposure is performed under the corrected exposure conditions (S205).

The temperature characteristics of the photosensitive drum 1 generally have a tendency described below. That is, the sensitivity and dark-decay characteristics become higher (increase) with an increase in temperature. Therefore, in a region that has a temperature higher than the reference temperature in setting of the potential decay characteristic table, the actual value is lower than the surface potential value (absolute value) in the development position indicated in the potential decay characteristic table. To address this, in such a high-temperature region, the exposure dose is set so as to be smaller than the exposure dose at the reference temperature. In contrast, in a region that has a temperature lower than the reference temperature, the actual value is higher than the surface potential value (absolute value) in the development position indicated in the potential decay characteristic table. To address this, in such a low-temperature region, the exposure dose is set so as to be larger than the exposure dose at the reference temperature.

In the present embodiment, a temperature gradient inside the main body A of the apparatus is treated as uniform in the longitudinal direction of the photosensitive drum 1. Values between the measured values by the first and second temperature sensors 12A and 12B are estimated by linear interpolation. In accordance with its inclination (gradient), the potential decay characteristic table is temperature-compensated.

Depending on configuration of the image forming apparatus 100, for example, when the central area in the longitudinal direction of the photosensitive drum 1 has a high temperature, it may be difficult to perform linear interpolation on the inside of the main body A of the apparatus in some cases. In such cases, it can be effective to predict temperature in the central area from the results of measurement by the first and second temperature sensors 12A and 12B and to interpolate values between them with a curve. More specifically, temperature distribution within the apparatus is measured, the characteristics of the distribution are treated as unique to the apparatus configuration, and a temperature difference is treated as a characteristic value (for example, a difference from a result of measurement by the first temperature sensor 12A). It is also possible to perform linear interpolation using three points of the measured temperatures by the first and second temperature sensors 12A and 12B and a temperature of the central area of the photosensitive drum 1 predicted by the measured value by the first temperature sensor 12A.

By use of a process in the present embodiment, unevenness in potential arising from influence of temperature distribution inside the main body A of the apparatus resulting from temperature dependence of the potential decay characteristics of the photosensitive drum 1 being the a-Si photo conductor can be corrected. Therefore, even when unevenness in temperature is present inside the image forming apparatus 100, an excellent image whose image-density irregularities are suppressed can be formed.

As described above, according to the present embodiment, two or more temperature sensors 12 configured to measure temperatures of adjacent areas of the surface of the photosensitive drum 1 are disposed in the longitudinal direction of the photosensitive drum 1. The potential decay characteristic table is corrected using the temperature characteristics of the surface potential of the photosensitive drum 1 based on the data measured by the temperature sensors 12 (12A, 12B). In such a manner, the exposure conditions (applicable to both a pulse-width modulation and an intensity modulation) are changed in accordance with the potential decay characteristic table corrected based on the temperature distribution in adjacent areas of the surface of the photosensitive drum 1. This can substantially eliminate unevenness in potential resulting from a difference in film thickness or film quality in the photosensitive layer of the photosensitive drum 1 in the developing portion. Consequently, according to the present embodiment, even when unevenness in temperature is present inside the image forming apparatus, an excellent image whose image-density irregularities are suppressed is obtainable.

The present embodiment is particularly useful for an image forming apparatus that does not include a heater for controlling temperature disposed inside the photosensitive drum 1. That is, according to the present embodiment, a temperature control device for maintaining the temperature of the photosensitive drum 1 constant, such as a heater, can be omitted or simplified.

In the present embodiment, a temperature gradient inside the main body A of the apparatus is treated as uniform in the longitudinal direction of the photosensitive drum 1, values between the measured values by the first and second temperature sensors 12A and 12B are linearly interpolated, and, in accordance with its inclination (gradient), the potential decay characteristic table is temperature-compensated. This can substantially eliminate influence of unevenness in potential using a smaller number of the temperature sensors 12 than the number of partitions of the potential decay characteristics in the longitudinal direction of the photosensitive drum 1 even when unevenness in temperature occurs in the surface of the photosensitive drum 1. In the present embodiment, the potential decay characteristic table is divided in the main scanning direction (longitudinal direction of the photo conductor) and in the sub-scanning direction (rotational direction of the photo conductor) in optical scanning of the exposure device 3. However, the potential decay characteristic table can have partitions only in the main scanning direction. In this case, exposure can be controlled based on at least the potential decay characteristics in the longitudinal direction of the photo conductor and the temperature characteristics in the longitudinal direction.

Third Embodiment

In the first embodiment, assuming that the amount of change in sensitivity characteristic of the photosensitive drum 1 caused by change in temperature is uniform in the longitudinal direction of the photosensitive drum 1, the exposure conditions are corrected. Accordingly, for a sensitivity characteristic in which when the temperature increases by 1° C. the exposure potential decreases by 3 V at one end of the photosensitive drum 1 in the longitudinal direction thereof, the exposure potential is considered to decrease by 3 V at the other end of the photosensitive drum 1 in the longitudinal direction thereof.

However, the amount of change in sensitivity characteristic of the photosensitive drum 1 caused by change in temperature may be non-uniform in the longitudinal direction. For example, for a sensitivity characteristic in which when the temperature increases by 1° C. the exposure potential decreases by 3 V at one end of the photosensitive drum 1 in the longitudinal direction thereof, the exposure potential may decrease by only 2 V at the other end of the photosensitive drum 1 in the longitudinal direction thereof. In particular, in the case of the a-Si photo conductor, a film forming state may be non-uniform in the longitudinal direction, and the amount of change in sensitivity characteristic caused by change in temperature may be different in the longitudinal direction. In this case, if temperature compensation is uniformly performed in the longitudinal direction of the photosensitive drum 1, a desired exposure potential may not be obtained. In the present embodiment, the memory chip 300 (FIGS. 4A and 4B) is included as a storage unit that stores the temperature characteristics for regions into which the surface of the photosensitive drum 1 is divided in the longitudinal direction in addition to the potential decay characteristic table described in the second embodiment. The longitudinal direction of the photosensitive drum 1 is typically a direction transverse to (substantially perpendicular to) the direction of movement of the surface of the photosensitive drum 1 (rotational direction thereof) and is typically a main scanning direction in optical scanning of the exposure device 3. The temperature characteristic of the surface potential is typically the amount of change in the surface potential per unit temperature.

Figure 18:
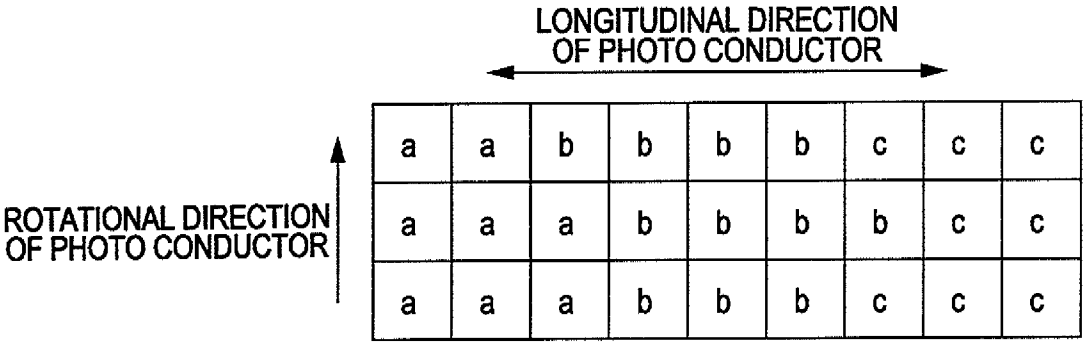
FIG. 18 is a schematic diagram of temperature characteristics of a plurality of regions of the surface of the photosensitive drum according to a third embodiment.

As illustrated in FIG. 18, the temperature characteristic for each region is set in three levels of a, b, and c. In regions "a", the exposure potential decreases by 1 V with an increase of 1° C. in temperature. In regions "b", the exposure potential decreases by 2 V with an increase of 1° C. in temperature. In regions "c", the exposure potential decreases by 3 V with an increase of 1° C. in temperature. That is, the amount of change in potential caused by a change in temperature is small in the regions a, whereas that is large in the regions c.

The exposure conditions for exposure performed by the exposure device 3 can be changed in accordance with temperature measured by the temperature measuring device and the potential decay characteristic table containing a potential decay characteristic for each region and the temperature characteristic for each region stored in the memory chip 300. More specifically, the potential decay characteristic table containing a potential decay characteristic for each region is corrected based on measured temperatures and a temperature characteristic for each region, and a new temperature-compensated potential decay characteristic table is created. In accordance with this table, the exposure conditions are adjusted.

The temperature-compensated potential decay characteristic table can be calculated in a manner described below. Temperatures at different two or more locations of the photosensitive drum 1 are measured by temperature sensors being a temperature measuring device. Temperature distribution in the longitudinal direction of the photosensitive drum 1 is determined. The image processing circuit 200 calculates a temperature variation (temperature difference) from the reference temperature (42° C. in the present embodiment) in generation of the potential decay characteristic table stored in the memory chip 300 in each region in the longitudinal direction of the photosensitive drum 1 from the determined temperature distribution. By multiplying the temperature difference in each region in the longitudinal direction of the photosensitive drum 1 and the temperature characteristic in the surface potential of the photosensitive drum 1 together, the value of the surface potential of each region in the development position shown in the potential decay characteristic table stored in the memory chip 300 is corrected. Unlike the second embodiment, in the present embodiment, because the temperature characteristic is different for each region, the amount of correction is different for each region. In such a manner, the temperature-compensated potential decay characteristic table is calculated, and in accordance with this table, the exposure conditions are adjusted. Specific configuration other than calculation of the potential decay characteristic table is substantially the same as in the second embodiment, so the description thereof is not repeated here.

Fourth Embodiment

Another embodiment of the present invention will now be described below. The fundamental configuration and operation of an image forming apparatus in the present embodiment are substantially the same as in the second embodiment. The same reference numerals are used as in the second embodiment for similar parts or parts having corresponding functions or structures, so the detailed description thereof is omitted.

Figure 14:
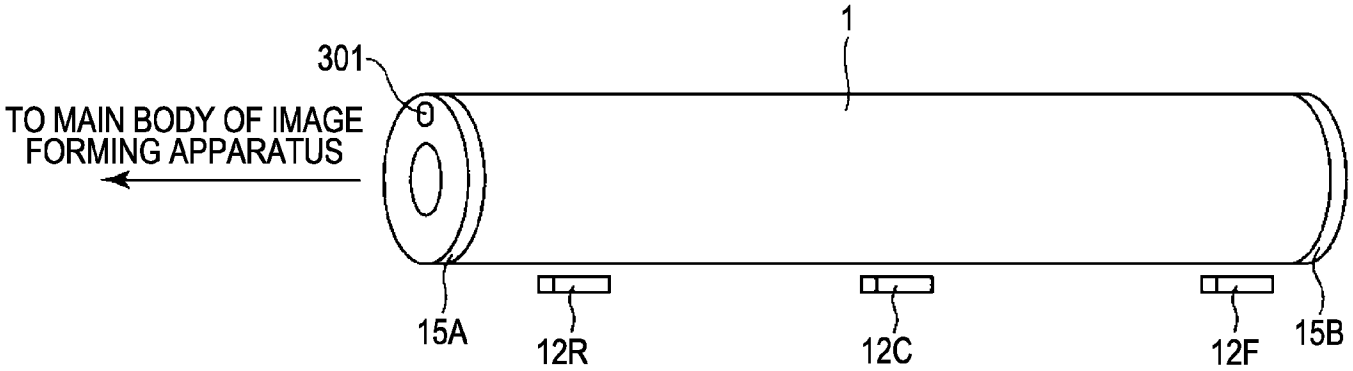
FIG. 14 is a schematic perspective view of the photosensitive drum and its surroundings according to a fourth embodiment.

In the present embodiment, as illustrated in FIG. 14, the potential decay characteristic table of the photosensitive drum 1 is stored in a tag memory 301 being a non-contact memory as a storage unit of the photosensitive drum 1.

Figure 15:
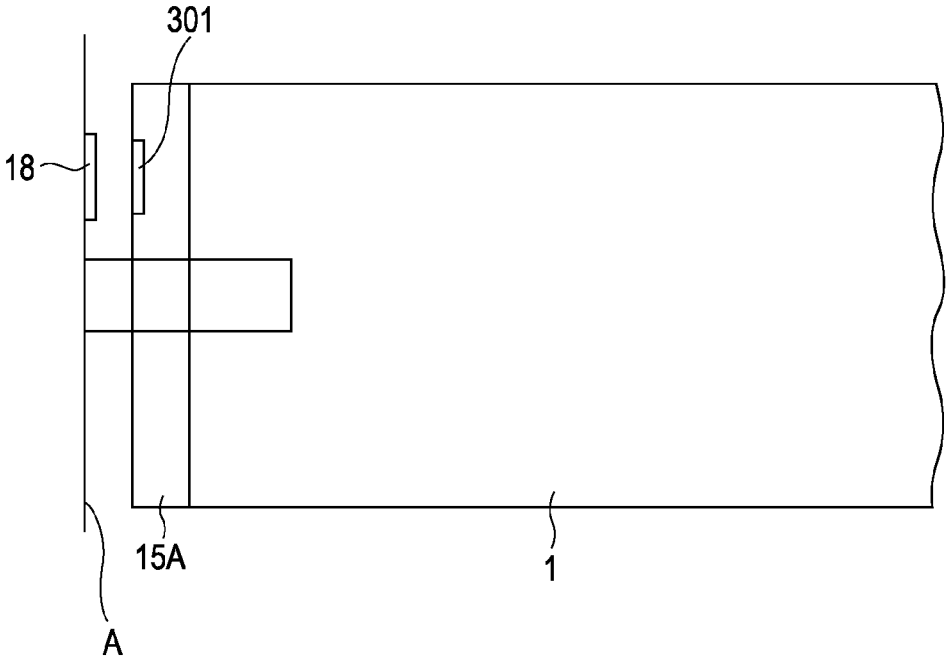
FIG. 15 is a sectional view that illustrates the photosensitive drum including a tag memory and an antenna substrate of the main body of the image forming apparatus.

In the present embodiment, as illustrated in FIG. 15, an antenna substrate 18 being a reading unit is disposed on, for example, the rear side of the inside of the main body A of the apparatus (the rear side being adjacent to the leading end of the photosensitive drum 1 when the photosensitive drum 1 is mounted in the main body A of the apparatus). The antenna substrate 18 can wirelessly communicate with the tag memory 301 of the photosensitive drum 1.

In the present embodiment, as illustrated in FIG. 14, the temperature sensors 12 configured to measure temperatures of adjacent areas of the surface of the photosensitive drum 1 are disposed in three locations of the rear side of the main body A of the apparatus (a first temperature sensor 12R), the substantially central part (a second temperature sensor 12C), and the front side (a third temperature sensor 12F).

More specifically, in the present embodiment, the first, second, and third temperature sensors 12R, 12C, and 12F are the same as in the first embodiment. The length of the photosensitive drum 1 in the photosensitive drum 1 is approximately 380 mm, whereas the first temperature sensor 12R is located approximately 20 mm away from the rear end of the photosensitive drum 1, the second temperature sensor 12C is located in the substantially central part of the photosensitive drum 1, and the third temperature sensor 12F is located approximately 20 mm away from the front end of the photosensitive drum 1. The distance between the photosensitive drum 1 and each of the first, second, and third temperature sensors 12R, 12C, and 12F is approximately 5 mm.

In the present embodiment, temperature distribution inside the main body A of the apparatus is calculated in a manner described below. By using values between three values measured by the first, second, and third temperature sensors 12R, 12C, and 12F estimated by spline interpolation, the temperature distribution in the longitudinal direction of adjacent areas of the surface of the photosensitive drum 1 is obtained.

The temperature distribution can be obtained using an interpolation process commonly used in numerical analysis, such as the method of least squares, Lagrange interpolation, and Hermite interpolation, in addition to the spline interpolation. These interpolation processes themselves are well known in the art. In the present embodiment, any available process can be selected and applied.

By performing substantially the same processing as in the first embodiment using the temperature distribution obtained in the foregoing manner, the potential decay characteristic table corrected based on the temperature characteristics of the photosensitive drum 1 is calculated.

Then, the exposure correction process is performed using the obtained new potential decay characteristic table in a manner described in the first embodiment, and an image is output.

By use of a process in the present embodiment, the temperature distribution inside the main body A of the apparatus can be determined more accurately. Accordingly, even when the temperature distribution in adjacent areas of the surface of the photosensitive drum 1 is uneven in the longitudinal direction, image-density irregularities can be corrected.

In the present embodiment, the potential decay characteristic table is temperature-compensated using spline interpolation of values between the measured values by the first, second, and third temperature sensors 12R, 12C, and 12F. This can substantially eliminate influence of unevenness in potential using a smaller number of the temperature sensors 12 than the number of partitions of the potential decay characteristics in the longitudinal direction of the photosensitive drum 1 even when unevenness in temperature occurs in the surface of the photosensitive drum 1.

The present embodiment is particularly useful for an image forming apparatus that does not include a heater for controlling temperature disposed inside the photosensitive drum 1, as in the case of the first embodiment.

In the above embodiments, a case in which an a-Si photo conductor, to which advantages of the present invention are particularly provided, is used as an image bearing member is described. However, the present invention is not limited to this case. The present invention is also applicable to a case in which an image bearing member other than the a-Si photo conductor, for example, an organic photo conductor is used.

In the above embodiments, the storage unit that stores the potential decay characteristic table is formed integrally with the image bearing member and is typically detachable from the main body of the apparatus. This is significantly useful because it is easy to perform control based on the potential decay characteristic table corresponding to an image bearing member, which is a consumable product and thus will be replaced with a new one. However, the present invention is not limited to this arrangement. The storage unit can be mounted in the main body of the apparatus other than the image bearing member.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. An image forming apparatus comprising:

a photo conductor;

a charging device configured to charge a surface of the photo conductor;

an exposure device configured to expose the charged surface of the photo conductor and to form an electrostatic image thereon;

a developing device configured to attach toner to the electrostatic image and to develop the electrostatic image as a toner image;

a plurality of temperature measuring devices, each configured to measure a temperature at a different location; and a control device configured to divide the photo conductor into a plurality of regions of which the number is greater than that of the temperature measuring devices, and individually set, for each region, an exposure condition for exposure performed by the exposure device, wherein in a case where there are differences in values among the measured temperatures measured by the plurality of temperature measuring devices, the control device calculates a temperature in each of the plurality of regions based on the values of the temperatures, and individually sets the exposure condition for each region based on the temperature calculated for the region.

2. The image forming apparatus according to claim 1, further comprising:

a storage unit configured to store information on a temperature characteristic of a surface potential for each of the plurality of regions, wherein the control device is operable to change the exposure condition for exposure performed by the exposure device in a longitudinal direction of the photo conductor in accordance with the measurement results of the temperature measuring devices and the information on the temperature characteristic of the surface potential for each of the plurality of regions.

3. The image forming apparatus according to claim 1 further comprising:

a storage unit configured to store information on a potential decay characteristic indicating a potential decay characteristic for each of the plurality of regions, wherein the control device is operable to change the exposure condition for exposure performed by the exposure device in accordance with the measurement results of the temperature measuring devices and the information on the potential decay characteristic for each of the plurality of regions.

4. The image forming apparatus according to claim 1 further comprising:

a storage unit configured to store information on a potential decay characteristic indicating a potential decay characteristic for each of the plurality of regions, wherein the control device is operable to change the exposure condition for exposure performed by the exposure device in accordance with the measurement results of the temperature measuring devices and the information on the potential decay characteristic for each of the plurality of regions.

5. The image forming apparatus according to claim 1 further comprising:

a datum-point detecting unit configured to detect a datum point of the photo conductor.

6. The image forming apparatus according to claim 1, wherein the photo conductor includes a non-single-crystal material that contains silicon atoms as a matrix and at least one of hydrogen atoms and halogen atoms.

* * * * *